US010379460B2

(12) United States Patent
Arimura et al.

(10) Patent No.: US 10,379,460 B2
(45) Date of Patent: Aug. 13, 2019

(54) ELECTROPHOTOGRAPHIC MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Hideya Arimura, Shizuoka (JP); Shohei Urushihara, Suntou-gun (JP); Masaki Yamada, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 143 days.

(21) Appl. No.: 15/634,362

(22) Filed: Jun. 27, 2017

(65) Prior Publication Data

US 2018/0011418 A1 Jan. 11, 2018

(30) Foreign Application Priority Data

Jul. 8, 2016 (JP) ..... 2016-135851

(51) Int. Cl.

| | |
|---|---|
| ***G03G 15/08*** | (2006.01) |
| ***G03G 15/02*** | (2006.01) |
| ***G03G 21/00*** | (2006.01) |
| ***G03G 15/16*** | (2006.01) |

(52) U.S. Cl.

CPC ..... *G03G 15/0808* (2013.01); *G03G 15/0233* (2013.01); *G03G 15/0812* (2013.01); *G03G 15/0818* (2013.01); *G03G 21/0017* (2013.01); *G03G 15/1685* (2013.01)

(58) Field of Classification Search

CPC ..... G03G 15/0808; G03G 15/0233; G03G 15/0812; G03G 15/0818; G03G 15/1685; G03G 21/0017

See application file for complete search history.

(56) References Cited

U.S. PATENT DOCUMENTS

| | | | |
|---|---|---|---|
| 7,797,833 | B2 | 9/2010 | Nakamura et al. |
| 7,799,398 | B2 | 9/2010 | Nakamura et al. |
| 8,529,806 | B2 | 9/2013 | Kawamura et al. |
| 8,600,273 | B2 | 12/2013 | Yamada et al. |
| 8,655,222 | B2 | 2/2014 | Nakamura et al. |
| 8,655,238 | B2 | 2/2014 | Uno et al. |
| 8,706,011 | B2 | 4/2014 | Anan et al. |
| 8,768,226 | B2 | 7/2014 | Koyanagi et al. |
| 8,768,227 | B2 | 7/2014 | Urushihara et al. |
| 8,774,677 | B2 | 7/2014 | Sakurai et al. |
| 8,798,508 | B2 | 8/2014 | Yamada et al. |
| 8,837,985 | B2 | 9/2014 | Ishida et al. |
| 8,846,287 | B2 | 9/2014 | Yamada et al. |
| 8,874,007 | B2 | 10/2014 | Kawamura et al. |
| 8,874,012 | B2 | 10/2014 | Yamada et al. |
| 8,913,930 | B2 | 12/2014 | Ishii et al. |
| 9,581,931 | B2 | 2/2017 | Yamada et al. |
| 9,599,913 | B2 | 3/2017 | Nishioka et al. |
| 9,639,009 | B2 | 5/2017 | Yamaguchi et al. |
| 9,665,028 | B2 | 5/2017 | Arimura et al. |
| 2013/0164038 | A1 | 6/2013 | Kusaba et al. |
| 2013/0266339 | A1 | 10/2013 | Sugiyama et al. |
| 2015/0331339 | A1 | 11/2015 | Yamada et al. |
| 2015/0331340 | A1 | 11/2015 | Nishioka et al. |
| 2015/0331342 | A1 | 11/2015 | Yamaguchi et al. |
| 2015/0331346 | A1 | 11/2015 | Yamauchi et al. |
| 2015/0331347 | A1 | 11/2015 | Arimura et al. |
| 2016/0187801 | A1 | 6/2016 | Yamada et al. |
| 2016/0187809 | A1 | 6/2016 | Yamaguchi et al. |
| 2016/0363881 | A1 | 12/2016 | Urushihara et al. |
| 2017/0060007 | A1 | 3/2017 | Yamada et al. |

FOREIGN PATENT DOCUMENTS

| | | | | |
|---|---|---|---|---|
| JP | 2006-274139 | A | 10/2006 | |
| JP | 2011215467 | * | 10/2011 | ..... F16C 13/00 |
| JP | 2011215467 | A | 10/2011 | |
| JP | 2012-037644 | A | 2/2012 | |
| JP | 2015-161889 | | 9/2015 | |

OTHER PUBLICATIONS

U.S. Appl. No. 15/421,570, Takashi Koyanagi, filed Feb. 1, 2017.
U.S. Appl. No. 15/493,282, Shohei Urushihara, filed Apr. 21, 2017.
U.S. Appl. No. 15/647,899, Fumihiko Utsuno, filed Jul. 12, 2017.

* cited by examiner

*Primary Examiner* — Amina S Khan
(74) *Attorney, Agent, or Firm* — Venable LLP

(57) ABSTRACT

Provided is an electrophotographic member including an electro-conductive substrate and a surface layer on the substrate. The surface layer contains a urethane resin and a first polymer having a specific nitrogen-containing structure. The urethane resin has a structure derived from a second polymer containing a fluorine atom or a structure derived from a third polymer containing a fluorine atom and a silicon atom. The surface layer contains nitrogen atoms derived from the nitrogen-containing structure at a specific ratio in a region from the outer surface of the surface layer to a depth of 300 nm, and the atomic ratios of nitrogen atoms, fluorine atoms, and silicon atoms in a region from a depth of 100 nm from the outer surface of the surface layer to a depth of 300 nm and a region from the outer surface to a depth of 10 nm have specific relationships.

11 Claims, 2 Drawing Sheets

ELECTROPHOTOGRAPHIC MEMBER, PROCESS CARTRIDGE, AND ELECTROPHOTOGRAPHIC APPARATUS

BACKGROUND OF THE INVENTION

Field of the Invention

The present invention relates to an electrophotographic member to be used in an electrophotographic apparatus, and to a process cartridge and an electrophotographic apparatus each including the electrophotographic member.

Description of the Related Art

An electrophotographic member is used for various applications, such as a developer carrying member (hereinafter referred to as "developing roller"), a transfer roller, a charging member (e.g., a charging roller), a developer-supplying roller, a cleaning blade, and a developer layer thickness regulating member (hereinafter referred to as "developing blade").

In Japanese Patent Application Laid-Open No. 2015-161889, there is a disclosure of an invention intended to provide an electrophotographic member that can simultaneously exhibit a sliding property and/or toner releasability on the surface of the member, and toner chargeability under a high-temperature and high-humidity environment. In addition, in Japanese Patent Application Laid-Open No. 2015-161889, there is a disclosure that the object can be achieved by an electrophotographic member in which: a polymer layer in the surface of the electrophotographic member contains a matrix polymer forming the framework of the polymer layer and a surface modifier added to the matrix polymer; and the surface modifier is formed of a copolymer containing a first polymerization unit based on a first compound having a silicone group in a molecule thereof and/or a second polymerization unit based on a second compound having a fluorine-containing group in a molecule thereof, and a third polymerization unit based on a third compound formed of a salt of a quaternary ammonium cation and a hydrophobic anion.

The inventors of the present invention have formed an electrophotographic image with a process cartridge mounted with the electrophotographic member according to Japanese Patent Application Laid-Open No. 2015-161889 serving as a developing member. As a result, fogging has sometimes occurred in the electrophotographic image under a high-temperature and high-humidity environment having, for example, a temperature of 32° C. and a relative humidity of 95%.

One aspect of the present invention is directed to the provision of an electrophotographic member that can provide a high-quality electrophotographic image even when used as a developing member under a high-temperature and high-humidity environment. In addition, another aspect of the present invention is directed to the provision of a process cartridge and an electrophotographic apparatus conducive to stable formation of high-quality electrophotographic images.

SUMMARY OF THE INVENTION

According to one aspect of the present invention, there is provided an electrophotographic member, including:

an electro-conductive substrate; and an electro-conductive resin layer serving as a surface layer on the substrate, in which:

the surface layer contains a urethane resin and a first polymer having at least one structure selected from the group consisting of structures represented by the following structural formulae (1) to (6);

the urethane resin has one of a structure derived from a second polymer containing a fluorine atom, and a structure derived from a third polymer containing a fluorine atom and a silicon atom;

wherein, in a region from an outer surface of the surface layer to a depth of 300 nm, a ratio of a total number of nitrogen atoms derived from the structures represented by the structural formulae (1) to (6) in the first polymer to a total number of atoms measured by X-ray photoelectron spectroscopy (ESCA), is 0.1 atomic % or more and 7.0 atomic % or less, and wherein, when, in a region from a depth of 100 nm from the outer surface of the surface layer to a depth of 300 nm, a ratio of a total number of nitrogen atoms derived from the structures represented by the structural formulae (1) to (6) in the first polymer to a total number of atoms measured by the X-ray photoelectron spectroscopy (ESCA) is defined as Nna, a ratio of a number of fluorine atoms derived from the urethane resin to the total number of the atoms measured by the X-ray photoelectron spectroscopy (ESCA) is defined as Fna, and a ratio of a number of silicon atoms derived from the urethane resin to the total number of the atoms measured by the X-ray photoelectron spectroscopy (ESCA) is defined as Sina;

and in a region from the outer surface of the surface layer to a depth of 10 nm, a ratio of a total number of nitrogen atoms derived from the structures represented by the structural formulae (1) to (6) in the first polymer to a total number of atoms measured by the X-ray photoelectron spectroscopy (ESCA) is defined as Nnb, a ratio of a number of fluorine atoms derived from the urethane resin to the total number of the atoms measured by the X-ray photoelectron spectroscopy (ESCA) is defined as Fnb, and a ratio of a number of silicon atoms derived from the urethane resin to the total number of the atoms measured by the X-ray photoelectron spectroscopy (ESCA) is defined as Sinb, the Nna, the Fna, the Sina, the Nnb, the Fnb, and the Sinb satisfy relationships represented by the following expression (1) and the following expression (2):

$$(Fna+Sina)<(Fnb+Sinb) \quad \text{Expression (1)}$$

$$Nna>Nnb. \quad \text{Expression (2)}$$

(1)

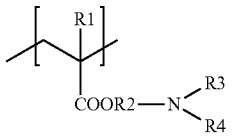

-continued (2)

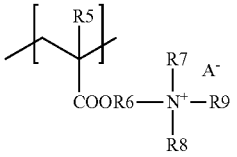

(3)

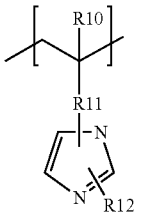

(4)

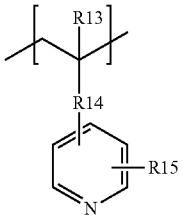

(5)

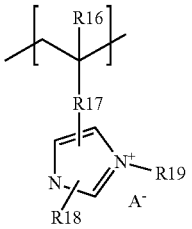

(6)

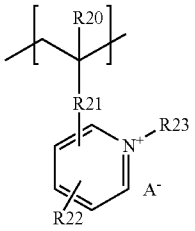

In the structural formulae (1) to (6),

R1, R5, R10, R13, R16, and R20 each independently represent a hydrogen atom or a methyl group, R2 and R6 each independently represent a hydrocarbon chain having 2 to 4 carbon atoms, R3 and R4 each independently represent a methyl group or an ethyl group, R7, R8, and R9 each independently represent a hydrocarbon group having 1 to 18 carbon atoms, R11, R14, R17, and R21 each independently represent a single bond or a hydrocarbon chain having 1 to 6 carbon atoms, R12, R15, R18, and R22 each independently represent a hydrogen atom or a hydrocarbon group having 1 to 3 carbon atoms, R19 and R23 each independently represent a hydrocarbon group having 1 to 13 carbon atoms, and $A^-$'s each independently represent a halogen ion or a p-toluenesulfonate ion.

In addition, according to another aspect of the present invention, there are provided a process cartridge removably mounted onto the main body of an electrophotographic apparatus, the process cartridge including the electrophotographic member, and an electrophotographic apparatus including the electrophotographic member.

Further features of the present invention will become apparent from the following description of exemplary embodiments with reference to the attached drawings.

DESCRIPTION OF THE EMBODIMENTS

Figure 1A:
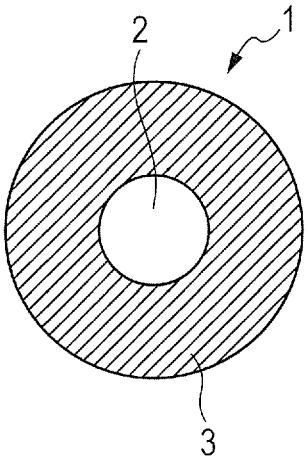
FIG. 1A, FIG. 1B, and FIG. 1C are each a sectional view for illustrating an electrophotographic roller according to one aspect of the present invention.

Preferred embodiments of the present invention will now be described in detail in accordance with the accompanying drawings.

An electrophotographic member according to one aspect of the present invention includes an electro-conductive substrate and an electro-conductive resin layer serving as a surface layer on the substrate. In addition, the surface layer contains a urethane resin and a first polymer having at least one structure selected from the group consisting of structures represented by the structural formulae (1) to (6). The urethane resin has a structure derived from a polymer containing a fluorine atom (second polymer) or a structure derived from a polymer containing a fluorine atom and a silicon atom (third polymer). The surface layer contains nitrogen atoms derived from the structures represented by the structural formulae (1) to (6) in a region from the outer surface of the surface layer to a depth of 300 nm, and the ratio of the total number of nitrogen atoms derived from the structures represented by the structural formulae (1) to (6) in the first polymer to the total number of atoms measured by X-ray photoelectron spectroscopy (ESCA) in the region from the outer surface of the surface layer to a depth of 300 nm is 0.1 atomic % or more and 7.0 atomic % or less. When the ratio of the total number of nitrogen atoms derived from the structures represented by the structural formulae (1) to (6) in the first polymer to the total number of atoms measured by the X-ray photoelectron spectroscopy (ESCA) in a region from a depth of 100 nm from the outer surface of the surface layer to a depth of 300 nm is defined as Nna, the ratio of the number of fluorine atoms derived from the urethane resin to the total number of the atoms measured by the X-ray photoelectron spectroscopy (ESCA) in the region from a depth of 100 nm from the outer surface of the surface layer to a depth of 300 nm is defined as Fna, the ratio of the number of silicon atoms derived from the urethane resin to the total number of the atoms measured by the X-ray photoelectron spectroscopy (ESCA) in the region from a depth of 100 nm from the outer surface of the surface layer to a depth of 300 nm is defined as Sina, the ratio of the total number of nitrogen atoms derived from the structures represented by the structural formulae (1) to (6) in the first polymer to the total number of atoms measured by the X-ray photoelectron spectroscopy (ESCA) in a region from the outer surface of the surface layer to a depth of 10 nm is defined as Nnb, the ratio of the number of fluorine atoms derived from the urethane resin to the total number of the atoms measured by the X-ray photoelectron spectroscopy (ESCA) in the region from the outer surface of the surface layer to a depth of 10 nm is defined as Fnb, and the ratio of the number of silicon atoms derived from the urethane resin to the total number of the atoms measured by the X-ray photoelectron spectroscopy (ESCA) in the region from the outer surface of the surface layer to a depth of 10 nm is defined as Sinb, the Nna, the Fna, the Sina, the Nnb, the Fnb, and the Sinb satisfy relationships represented by the following expression (1) and the following expression (2):

$$(Fna+Sina)<(Fnb+Sinb) \quad \text{Expression (1)}$$

$$Nna>Nnb. \quad \text{Expression (2)}$$

The inventors of the present invention have made an investigation, and as a result, have assumed that the fogging occurring in an electrophotographic image when the electrophotographic image is formed by using the electrophotographic member according to Japanese Patent Application Laid-Open No. 2015-161889 as a developing member results from the structure of the surface modifier in the polymer layer of the electrophotographic member according to Japanese Patent Application Laid-Open No. 2015-161889.

Figure 3:
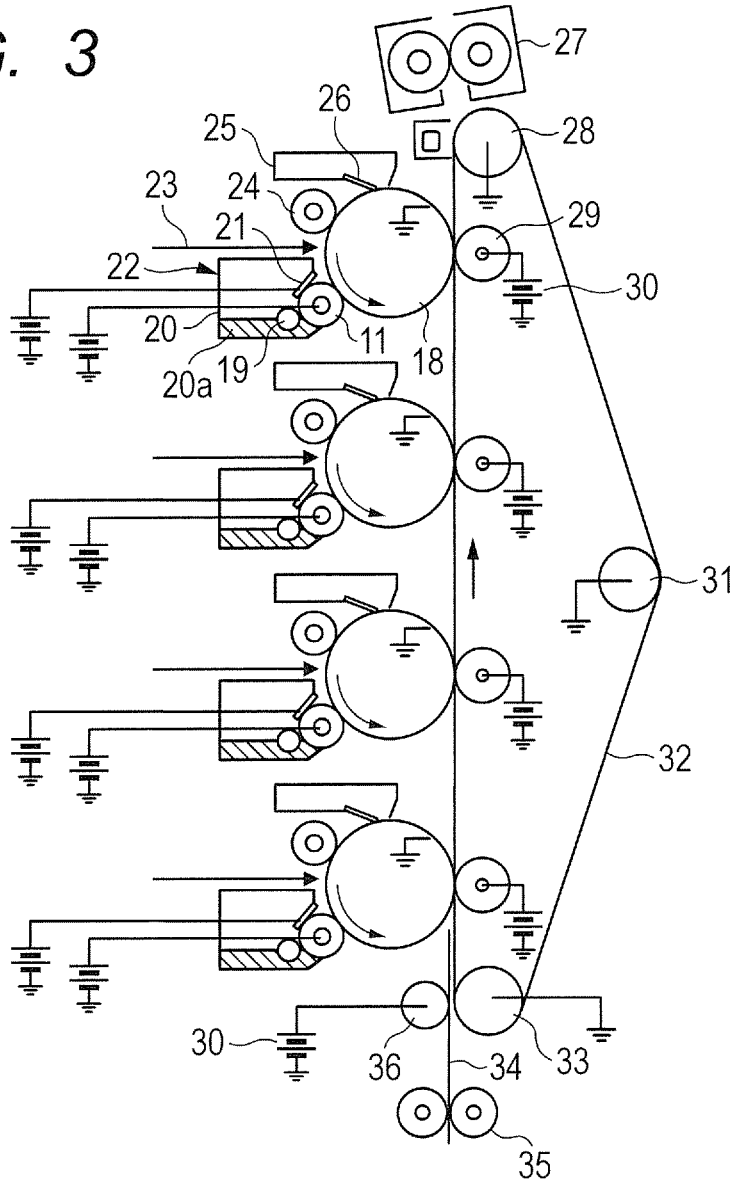
FIG. 3 is a schematic construction view for illustrating an electrophotographic apparatus according to one aspect of the present invention.

That is, the surface modifier according to Japanese Patent Application Laid-Open No. 2015-161889 has such a structure that the first polymerization unit to the third polymerization unit are grafted into the main chain of the copolymer as illustrated in FIG. 3 of Japanese Patent Application Laid-Open No. 2015-161889. Here, the third polymerization unit may undergo phase separation from the first polymerization unit and the second polymerization unit because there is a large difference in polarity between a quaternary ammonium cation present in the third polymerization unit, and each of a silicone group present in the first polymerization unit and a fluorine-containing group present in the second polymerization unit. As a result, a domain containing a quaternary ammonium cation, and a domain containing at least one of a silicone group or a fluorine-containing group are present on the surface of the electrophotographic member according to Japanese Patent Application Laid-Open No. 2015-161889. In addition, sufficient charge is not imparted to toner that has adhered to a portion where the domain containing a quaternary ammonium cation, the domain having an excellent triboelectric charge imparting ability to the toner, is not present, and as a result, the fogging may occur in the electrophotographic image.

Here, the inventors of the present invention have made an investigation on the position at which a nitrogen-containing structure that exhibits a triboelectric charge-imparting effect on toner in an electrophotographic member is present in the surface layer of the member. That is, the inventors of the present invention have recognized that the nitrogen-containing structure needs to be positioned on the outermost surface of the electrophotographic member to be brought into direct contact with the toner. However, the inventors have found that as long as the nitrogen-containing structure is incorporated in a predetermined amount into a region from the outermost surface to a depth of 300 nm, even when the structure is not necessarily present on the outermost surface, the structure exhibits a triboelectric charge-imparting effect on the toner. Then, in view of such finding, the inventors of the present invention have found that when a component excellent in toner releasability, specifically one, or each of both, of a fluorine-containing group and a silicone group is unevenly distributed in a region from the outermost surface of the surface layer to a depth of 10 nm while a predetermined amount of nitrogen atoms are incorporated into a region from the outermost surface to a depth of 300 nm, uneven distribution of the nitrogen-containing structure in the surface is suppressed, and hence the transformation of the nitrogen-containing structure into a domain can be suppressed while the excellent toner releasability is maintained.

That is, the electrophotographic member according to one aspect of the present invention includes an electro-conductive substrate and an electro-conductive resin layer serving as a surface layer on the substrate. In addition, the surface layer contains a first polymer having at least one structure selected from the group consisting of structures represented by the following structural formulae (1) to (6).

(1)

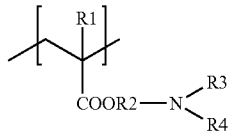

(2)

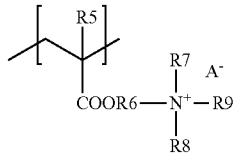

(3)

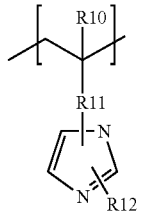

(4)

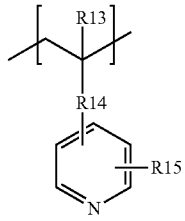

(5)

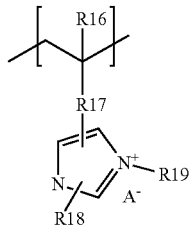

(6)

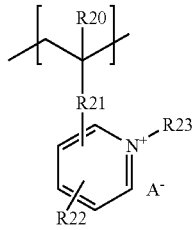

In the structural formulae (1) to (6),

R1, R5, R10, R13, R16, and R20 each independently represent a hydrogen atom or a methyl group, R2 and R6 each independently represent a hydrocarbon chain having 2 to 4 carbon atoms, R3 and R4 each independently represent a methyl group or an ethyl group, R7, R8, and R9 each independently represent a hydrocarbon group having 1 to 18 carbon atoms, R11, R14, R17, and R21 each independently represent a single bond or a hydrocarbon chain having 1 to 6 carbon atoms, R12, R15, R18, and R22 each independently represent a hydrogen atom or a hydrocarbon group having 1 to 3 carbon atoms, R19 and R23 each independently represent a hydrocarbon group having 1 to 13 carbon atoms, and $A^-$'s each independently represent a halogen ion or a p-toluenesulfonate ion.

In addition, the surface layer further contains a urethane resin having a specific structure in addition to the first polymer. That is, the urethane resin has a structure derived from a second polymer containing a fluorine atom or a structure derived from a third polymer containing a fluorine atom and a silicon atom.

Further, the ratio of the total number of nitrogen atoms derived from the structures represented by the structural formulae (1) to (6) in the first polymer to the total number of atoms measured by the X-ray photoelectron spectroscopy (ESCA) in a region from the outer surface of the surface layer to a depth of 300 nm (hereinafter sometimes referred to as "Nn") is 0.1 atomic % or more and 7.0 atomic % or less. Thus, the electrophotographic member according to this embodiment has performance by which high triboelectric charge can be imparted to toner. A value for the Nn is preferably 0.1 atomic % or more and 5.0 atomic % or less.

Further, the surface layer satisfies relationships represented by the expression (1) and the expression (2):

$$(Fna+Sina)<(Fnb+Sinb) \quad \text{Expression (1)}$$

$$Nna>Nnb. \quad \text{Expression (2)}$$

In the expressions (1) and (2), the Nna, the Nnb, the Fna, the Sina, the Fnb, and the Sinb are defined as described below:

Nna: the ratio of the total number of nitrogen atoms derived from the structures represented by the structural formulae (1) to (6) in the first polymer to the total number of atoms measured by the X-ray photoelectron spectroscopy (ESCA) in a region from a depth of 100 nm from the outer surface of the surface layer to a depth of 300 nm;

Fna: the ratio of the number of fluorine atoms derived from the urethane resin to the total number of the atoms measured by the X-ray photoelectron spectroscopy (ESCA) in the region from a depth of 100 nm from the outer surface of the surface layer to a depth of 300 nm;

Sina: the ratio of the number of silicon atoms derived from the urethane resin to the total number of the atoms measured by the X-ray photoelectron spectroscopy (ESCA) in the region from a depth of 100 nm from the outer surface of the surface layer to a depth of 300 nm;

Nnb: the ratio of the total number of nitrogen atoms derived from the structures represented by the structural formulae (1) to (6) in the first polymer to the total number of atoms measured by the X-ray photoelectron spectroscopy (ESCA) in a region from the outer surface of the surface layer to a depth of 10 nm;

Fnb: the ratio of the number of fluorine atoms derived from the urethane resin to the total number of the atoms measured by the X-ray photoelectron spectroscopy (ESCA) in the region from the outer surface of the surface layer to a depth of 10 nm; and Sinb: the ratio of the number of silicon atoms derived from the urethane resin to the total number of the atoms measured by the X-ray photoelectron spectroscopy (ESCA) in the region from the outer surface of the surface layer to a depth of 10 nm.

The expression (1) means that a portion derived from the second polymer and a portion derived from the third polymer in the urethane resin are oriented toward the outer surface of the surface layer. In addition, the expression (2) means that the first polymer is unevenly distributed in the region from a depth of 100 nm from the outer surface of the surface layer to a depth of 300 nm.

That is, in the surface layer according to this embodiment, the first polymer, and the portion derived from the second polymer and the portion derived from the third polymer, the first polymer and the portions being different from each other in polarity, are mainly present in different regions in a depth direction with reference to the outer surface of the surface layer. In other words, the first polymer having at least one of the structures represented by the structural formulae (1) to (6), the polymer exhibiting a high triboelectric charge imparting ability to the toner, is mainly present in the region from a depth of 100 nm from the outer surface of the surface layer to a depth of 300 nm, i.e., a deep region.

In addition, as described in the foregoing, the portion derived from the second polymer and the portion derived from the third polymer in the urethane resin are oriented toward the region from the outer surface of the surface layer to a depth of 10 nm. Accordingly, a portion except the portion derived from the second polymer and the portion derived from the third polymer in the urethane resin is present in the deep region. In addition, the portion except the portion derived from the second polymer and the portion derived from the third polymer in the urethane resin has a SP value relatively close to that of a structure portion represented by any one of the structural formulae (1) to (6) of the first polymer. Accordingly, it is assumed that in the region, the structure portion represented by any one of the formulae (1) to (6) hardly transforms into a domain and is hence dispersed in the urethane resin in a relatively uniform manner. As a result, the electrophotographic member including the surface layer according to this embodiment can impart more uniform triboelectric charge to the toner.

<Electrophotographic Member>

The electrophotographic member according to one aspect of the present invention includes the electro-conductive substrate and the electro-conductive resin layer serving as the surface layer on the substrate. In the present invention, the electrophotographic member refers to, for example, a developing roller, a transfer roller, a charging member, a toner-supplying roller, a developing blade, and a cleaning blade.

Figure 1B:
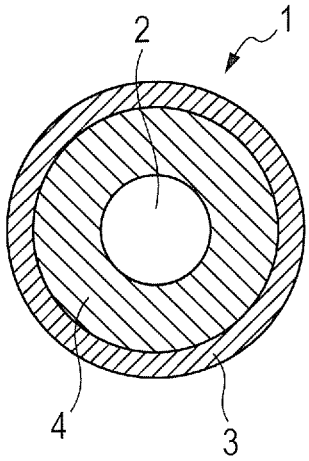
Figure 1C:
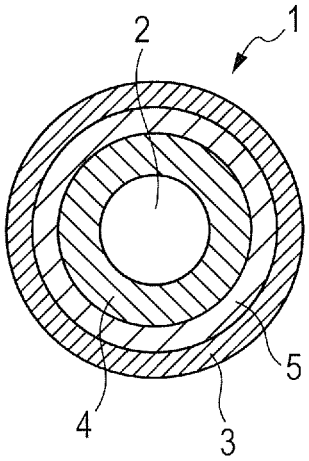

A roller-shaped electrophotographic member (electrophotographic roller) serving as one example of the electrophotographic member is illustrated in each of FIG. 1A to FIG. 1C. An electrophotographic roller 1 illustrated in FIG. 1A is formed of an electro-conductive substrate 2 and an electro-conductive resin layer 3 arranged on the outer periphery thereof. A plurality of the electro-conductive resin layers 3 may be arranged. In this specification, the outermost layer of the electro-conductive resin layer is referred to as "surface layer." In the electrophotographic roller 1, an elastic layer 4 may be further arranged between the substrate 2 and the electro-conductive resin layer 3 as illustrated in FIG. 1B. A plurality of the elastic layers 4 may be formed. In addition, the electrophotographic roller 1 may have a three-layer structure in which an intermediate layer 5 is further arranged between the elastic layer 4 and the electro-conductive resin layer 3 as illustrated in FIG. 1C, or may have a multi-layer structure in which a plurality of the intermediate layers 5 are arranged.

Figure 2A:
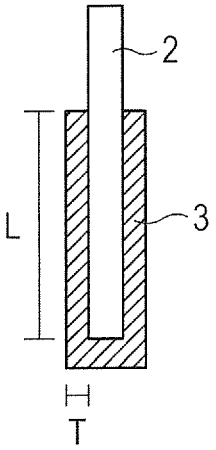
FIG. 2A and FIG. 2B are each a sectional view for illustrating an electrophotographic blade according to one aspect of the present invention.
Figure 2B:
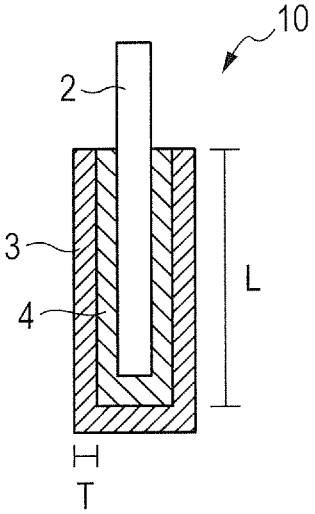

In addition, another example of the electrophotographic member is a blade-shaped electrophotographic member (electrophotographic blade). FIG. 2A and FIG. 2B are each a schematic sectional view of the electrophotographic blade. An electrophotographic blade 10 illustrated in FIG. 2A includes the electro-conductive substrate 2 and the electro-conductive resin layer 3 arranged on the outer periphery thereof. In the electrophotographic blade illustrated in FIG. 2B, the elastic layer 4 is further arranged between the substrate 2 and the electro-conductive resin layer 3.

The construction of the electrophotographic member according to one embodiment of the present invention is described in detail below.

[Substrate]

The substrate 2 functions as a solid or hollow electrode and support member for the electrophotographic member, such as the electrophotographic roller 1. The substrate 2 is formed of an electro-conductive material, such as: a metal, such as aluminum or copper; an alloy, such as stainless steel; iron subjected to a plating treatment with chromium or nickel; or a synthetic resin having electro-conductivity.

[Elastic Layer]

Particularly when the electrophotographic member has a roller shape (electrophotographic roller 1), the elastic layer 4 is configured to impart, to the electrophotographic roller 1, elasticity needed for forming a nip having a predetermined width in a portion where the electrophotographic roller 1 and an electrophotographic photosensitive member (hereinafter referred to as "photosensitive member") abut on each other. The elastic layer may be a single layer or may include a plurality of layers. In ordinary cases, the elastic layer 4 is preferably formed of a molded body of a rubber material. Examples of the rubber material include the following materials: an ethylene-propylene-diene copolymer rubber (EPDM), an acrylonitrile-butadiene rubber (NBR), a chloroprene rubber (CR), a natural rubber (NR), an isoprene rubber (IR), a styrene-butadiene rubber (SBR), a fluorine rubber, a silicone rubber, an epichlorohydrin rubber, a hydrogenated NBR, and a urethane rubber. Those materials may be used alone or in combination thereof. Of those, a silicone rubber is preferred from the viewpoints of compression set and flexibility. Examples of the silicone rubber include polydimethylsiloxane, polytrifluoropropylsiloxane, polymethylvinylsiloxane, polyphenylvinylsiloxane, and copolymers of those polysiloxanes.

Various additives, such as an electro-conductivity-imparting agent, a non-electro-conductive filler, a crosslinking agent, and a catalyst, are appropriately blended into the elastic layer 4 to the extent that an object of blending any such additive is achieved and the effects of the present invention are not impaired. As the electro-conductivity-imparting agent, there may be used: carbon black; an electro-conductive metal, such as aluminum or copper; fine particles of an electro-conductive metal oxide, such as zinc oxide, tin oxide, or titanium oxide; and an ionic electro-conductive agent, such as a quaternary ammonium salt. Of those, carbon black is preferred from the viewpoints of availability, an electro-conductivity imparting ability, and a reinforcing property. Examples of the non-electro-conductive filler include silica, quartz powder, titanium oxide, zinc oxide, and calcium carbonate. Examples of the crosslinking agent include, but not particularly limited to, tetraethoxysilane, di-t-butyl peroxide, 2,5-dimethyl-2,5-di(t-butylperoxy) hexane, and dicumyl peroxide. An example of the catalyst is a platinum catalyst.

[Surface Layer]

The electro-conductive resin layer 3 (hereinafter sometimes referred to as "surface layer") serving as a surface layer contains a urethane resin and a first polymer having at least one structure selected from the group consisting of structures represented by the following structural formulae (1) to (6). The urethane resin has a structure derived from a polymer containing a fluorine atom (second polymer) or a structure derived from a polymer containing a fluorine atom and a silicon atom (third polymer). The first polymer to be incorporated into the surface layer contributes to a triboelectric charge imparting ability to toner.

In the surface layer, the ratio of the total number of nitrogen atoms derived from the structures represented by the structural formulae (1) to (6) in the first polymer to the total number of atoms measured by X-ray photoelectron spectroscopy (ESCA) in a region from the outer surface of the surface layer to a depth of 300 nm is 0.1 atomic % or more and 7.0 atomic % or less, and when the ratio of the total number of nitrogen atoms derived from the structures represented by the structural formulae (1) to (6) in the first polymer to the total number of atoms measured by the X-ray photoelectron spectroscopy (ESCA) in a region from a depth of 100 nm from the outer surface of the surface layer to a depth of 300 nm is defined as Nna, the ratio of the number of fluorine atoms derived from the urethane resin to the total number of the atoms measured by the X-ray photoelectron spectroscopy (ESCA) in the region from a depth of 100 nm from the outer surface of the surface layer to a depth of 300 nm is defined as Fna, the ratio of the number of silicon atoms derived from the urethane resin to the total number of the atoms measured by the X-ray photoelectron spectroscopy (ESCA) in the region from a depth of 100 nm from the outer surface of the surface layer to a depth of 300 nm is defined as Sina, the ratio of the total number of nitrogen atoms derived from the structures represented by the structural formulae (1) to (6) in the first polymer to the total number of atoms measured by the X-ray photoelectron spectroscopy (ESCA) in a region from the outer surface of the surface layer to a depth of 10 nm is defined as Nnb, the ratio of the number of fluorine atoms derived from the urethane resin to the total number of the atoms measured by the X-ray photoelectron spectroscopy (ESCA) in the region from the outer surface of the surface layer to a depth of 10 nm is defined as Fnb, and the ratio of the number of silicon atoms derived from the urethane resin to the total number of the atoms measured by the X-ray photoelectron spectroscopy (ESCA) in the region from the outer surface of the surface layer to a depth of 10 nm is defined as Sinb, the Nna, the Fna, the Sina, the Nnb, the Fnb, and the Sinb satisfy relationships represented by the following expression (1) and the following expression (2):

$$(Fna+Sina)<(Fnb+Sinb) \quad \text{Expression (1)}$$

$$Nna>Nnb. \quad \text{Expression (2)}$$

The unit "atomic %" refers to a value measured by the X-ray photoelectron spectroscopy (ESCA (or XPS)) and represents the ratio ((X2/X1)×100) of the number of atoms of interest (X2) to the total number of atoms (X1) obtained by the measurement. Atoms that can be detected by the ESCA are atoms except hydrogen and helium.

The ESCA can identify atomic composition and a chemical bonding state in a region as far as 10 nm in a depth direction. In addition, the ESCA can analyze the distributions of the atomic composition and the chemical bonding state in the depth direction while etching an object with a fullerene ion.

Each component in the surface layer is described below.

(First Polymer)

The first polymer has at least one structure selected from the group consisting of the structures represented by the following structural formulae (1) to (6). The first polymer is obtained by polymerizing an acrylic monomer or vinyl polymerizable monomer having a specific functional group through the use of a known method. The structures represented by the structural formulae (1) to (6) are described below.

(1)

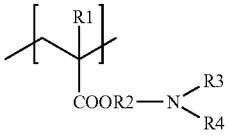

A structure represented by the structural formula (1) (hereinafter sometimes referred to as "structure (1)") represents a structure in which an acrylic acid ester monomer or methacrylic acid ester monomer having a tertiary amino group is polymerized. In the structural formula (1), R1 represents a hydrogen atom or a methyl group, R2 represents a hydrocarbon chain having 2 to 4 carbon atoms, and R3 and R4 each independently represent a methyl group or an ethyl group.

Specific examples of the monomer providing the structure represented by the structural formula (1) are given below:

N,N-dimethylaminomethyl (meth) acrylate, N,N-diethylaminomethyl (meth) acrylate, N,N-dimethylaminoethyl (meth) acrylate, N,N-diethylaminoethyl (meth) acrylate, N,N-dimethylaminopropyl (meth) acrylate, N,N-diethylaminopropyl (meth) acrylate, N,N-dimethylaminobutyl (meth) acrylate, and N,N-diethylaminobutyl (meth) acrylate. The term "(meth) acrylate" refers to methacrylate or acrylate (the same shall apply hereinafter).

(2)

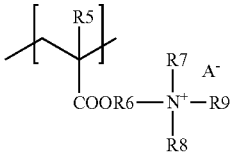

A structure represented by the structural formula (2) (hereinafter sometimes referred to as "structure (2)") represents a structure in which an acrylic acid ester monomer or methacrylic acid ester monomer having a quaternary ammonium salt group is polymerized. In the structural formula (2), R5 represents a hydrogen atom or a methyl group, R6 represents a hydrocarbon chain having 2 to 4 carbon atoms, R7, R8, and R9 each independently represent a hydrocarbon group having 1 to 18 carbon atoms, and R7, R8, and R9 each preferably represent an alkyl group having 1 to 18 carbon atoms, and $A^-$ represents a halogen ion or a p-toluenesulfonate ion.

Specific examples of the monomer providing the structure represented by the structural formula (2) are given below: halides and p-toluenesulfonates of a 2-[(meth)acryloyloxy]ethyltrimethylammonium cation, a [(meth)acryloyloxy]methyltrimethylammonium cation, a 2-[(meth)acryloyloxy]ethyldimethyl-n-butylammonium cation, a 2-[(meth)acryloyloxy]ethyltriethylammonium cation, a 2-[(meth)acryloyloxy]ethyldimethyl-n-octylammonium cation, a 2-[(meth)acryloyloxy]ethyldiethyl-n-octylammonium cation, a 2-[(meth)acryloyloxy]ethyldimethyllaurylammonium cation, a 2-[(meth)acryloyloxy]ethyldimethylstearylammonium cation, a 2-[(meth)acryloyloxy]ethyldimethyltridecylammonium cation, and a 2-[(meth)acryloyloxy]ethyltributylammonium cation.

(3)

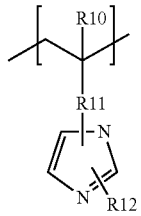

A structure represented by the structural formula (3) (hereinafter sometimes referred to as "structure (3)") represents a structure in which a vinylimidazole monomer is polymerized. In the structural formula (3), R10 represents a hydrogen atom or a methyl group, R11 represents a single bond or a hydrocarbon chain having 1 to 6 carbon atoms, and R12 represents a hydrogen atom or a hydrocarbon group having 1 to 3 carbon atoms, and R11 and R12 are each bonded to an arbitrary carbon atom or nitrogen atom of an imidazole ring.

Specific examples of the monomer providing the structure represented by the structural formula (3) are given below:

1-vinylimidazole, 1-allylimidazole, 1-(3-buten-1-yl)-1H-imidazole, 1-(4-penten-1-yl)-1H-imidazole, 1-(5-hexen-1-yl)-1H-imidazole, 1-(6-hepten-1-yl)-1H-imidazole, 2-(2-propen-1-yl)-1H-imidazole, 2-(3-buten-1-yl)-1-methyl-1H-imidazole, 2-(3-buten-1-yl)-1-ethyl-1H-imidazole, 2-(3-buten-1-yl)-1-propyl-1H-imidazole, 1-methyl-2-(4-penten-1-yl)-1H-imidazole, and 2-methyl-1-vinylimidazole.

(4)

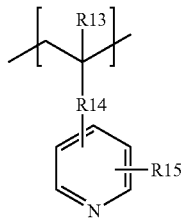

A structure represented by the structural formula (4) (hereinafter sometimes referred to as "structure (4)") represents a structure in which a vinylpyridine monomer is polymerized. In the structural formula (4), R13 represents a hydrogen atom or a methyl group, R14 represents a single bond or a hydrocarbon chain having 1 to 6 carbon atoms, and R15 represents a hydrogen atom or a hydrocarbon group having 1 to 3 carbon atoms, and R14 and R15 are bonded to arbitrary carbon atoms of a pyridine ring.

Specific examples of the monomer providing the structure represented by the structural formula (4) are given below:

2-vinylpyridine, 3-vinylpyridine, 4-vinylpyridine, 4-(2-propen-1-yl)pyridine, 4-(3-buten-1-yl)pyridine, 4-(5-hexen-1-yl)pyridine, 3-(2-propen-1-yl)pyridine, 3- (2-methyl-2-propen-1-yl)pyridine, 3-methyl-5-(2-propen-1-yl)pyridine, 4-methyl-3-(2-propen-1-yl)pyridine, 2-methyl-5-(2-methyl-2-propen-1-yl)pyridine, 4-methyl-3-(2-methyl-2-propen-1-yl)pyridine, 3-(3-buten-1-yl)pyridine, 3-(3-buten-1-yl)-5-methylpyridine, 3-(4-methyl-4-penten-1-yl)-pyridine, 5-methyl-2-(2-propen-1-yl)pyridine, 2-methyl-6-(2-propen-1-yl)pyridine, 5-ethyl-2-(2-propen-1-yl)pyridine, 3-methyl-2-(2-propen-1-yl)pyridine, 2-methyl-6-(2-methyl-2-propen-1-yl)pyridine, 5-methyl-2-(2-methyl-2-propen-1-yl) pyridine, 4-methyl-2-(2-methyl-2-propen-1-yl)pyridine, 2-(3-buten-1-yl)pyridine, 2-(3-methyl-3-buten-1-yl)pyridine, 2-(3-buten-1-yl)-6-methylpyridine, 2-(3-buten-1-yl)-5-methylpyridine, 2-(3-buten-1-yl)-4-methylpyridine, and 2-(3-buten-1-yl)-3-methylpyridine.

(5)

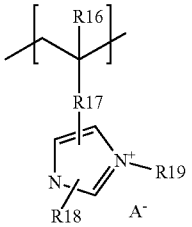

A structure represented by the structural formula (5) (hereinafter sometimes referred to as "structure (5)") represents a structure in which a vinylimidazolium monomer is polymerized. In the structural formula (5), R16 represents a hydrogen atom or a methyl group, R17 represents a single bond or a hydrocarbon chain having 1 to 6 carbon atoms, R18 represents a hydrogen atom or a hydrocarbon group having 1 to 3 carbon atoms, R19 represents a hydrocarbon group having 1 to 13 carbon atoms and R19 preferably represents an alkyl group having 1 to 13 carbon atoms, R17 and R18 are each bonded to the nitrogen atom of an imidazole ring that is not substituted with R19 or an arbitrary carbon atom thereof, and $A^-$ represents a halogen ion or a p-toluenesulfonate ion.

Specific examples of the monomer providing the structure represented by the structural formula (5) are given below. In each of the following exemplified compounds, the position number of $N^+$ is represented as "3".

Halides and p-toluenesulfonates of a 3-alkyl-1-vinylimidazolium cation, a 3-alkyl-1-allylimidazolium cation, a 3-alkyl-1-(3-buten-1-yl)imidazolium cation, a 3-alkyl-1-(4-penten-1-yl)imidazolium cation, a 3-alkyl-1-(5-hexen-1-yl) imidazolium cation, a 3-alkyl-1-(6-hepten-1-yl)imidazolium cation, a 3-alkyl-2-(2-propen-1-yl)-1H-imidazolium cation, a 3-alkyl-2-(3-buten-1-yl)-1-methylimidazolium cation, a 3-alkyl-2-(3-buten-1-yl)-1-ethylimidazolium cation, a 3-alkyl-2-(3-buten-1-yl)-1-propylimidazolium cation, a 3-alkyl-2-(4-penten-1-yl)-1-methylimidazolium cation, a 2,3-dimethyl-1-vinylimidazolium cation, and a 3-alkyl-2-methyl-1-vinylimidazolium cation. The term "alkyl" in each of the above-mentioned compounds refers to any one of methyl, ethyl, n-butyl, n-octyl, lauryl, and tridecyl.

(6)

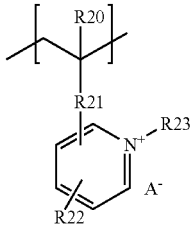

A structure represented by the structural formula (6) (hereinafter sometimes referred to as "structure (6)") represents a structure in which a vinylpyridinium monomer is polymerized. In the structural formula (6), R20 represents a hydrogen atom or a methyl group, R21 represents a single bond or a hydrocarbon chain having 1 to 6 carbon atoms, R22 represents a hydrogen atom or a hydrocarbon group having 1 to 3 carbon atoms, R23 represents a hydrocarbon group having 1 to 13 carbon atoms and R23 preferably represents an alkyl group having 1 to 13 carbon atoms, R21 and R22 are bonded to arbitrary carbon atoms of a pyridine ring, and $A^-$ represents a halogen ion or a p-toluenesulfonate ion.

Specific examples of the monomer providing the structure represented by the structural formula (6) are given below:

halides and p-toluenesulfonates of a 1-alkyl-2-vinylpyridinium cation, a 1-alkyl-3-vinylpyridinium cation, a 1-alkyl-4-vinylpyridinium cation, a 1-alkyl-4-(2-propen-1-yl)pyridinium cation, a 1-alkyl-4-(3-buten-1-yl)pyridinium cation, a 1-alkyl-4-(5-hexen-1-yl)pyridinium cation, a 1-alkyl-3-(2-propen-1-yl)pyridinium cation, a 1-alkyl-3-(2-methyl-2-propen-1-yl)pyridinium cation, a 1-alkyl-3-methyl-5-(2-propen-1-yl)pyridinium cation, a 1-alkyl-4-methyl-3-(2-propen-1-yl)pyridinium cation, a 1-alkyl-2-methyl-5-(2-methyl-2-propen-1-yl)pyridinium cation, and a 1-alkyl-4-methyl-3-(2-methyl-2-propen-1-yl)pyridinium cation. The term "alkyl" in each of the above-mentioned compounds refers to any one of methyl, ethyl, n-butyl, n-octyl, lauryl, and tridecyl.

The structures (1) to (6) containing nitrogen atoms each function as a segment configured to impart, to the first polymer, an excellent triboelectric charge imparting ability to the toner. Of those, the structures (1) and (2) are more preferred structures because each of the structures can further improve the triboelectric charge imparting ability of the first polymer to the toner. Electrons around nitrogen atoms in the structures (1) and (2) each form an $sp^3$ hybrid orbital. Meanwhile, electrons around nitrogen atoms in the structures (3) to (6) each form an $sp^2$ hybrid orbital. In addition, the ratio of an S orbital bound by an atomic nucleus with a strong force in the $sp^3$ hybrid orbital is lower than that in the $sp^2$ hybrid orbital. Accordingly, the structures (1) and (2) each have a particularly weak electron-binding force, and hence a further improvement in triboelectric charge imparting ability of the first polymer to the toner may be achieved. Further, molecules of the first polymer having the structures (1) and (2) are less liable to interact with each other than those of the first polymer having any one of the structures (3) to (6) are. Accordingly, the surface layer containing the first polymer having one or both of the structures (1) and (2) can more uniformly distribute the first polymer in the urethane resin in the surface layer. As a result, the surface layer can impart more uniform triboelectric charge to the toner. That is, the use of the electrophotographic member including such surface layer as a developing member can narrow the charge quantity distribution of the toner.

The first polymer to be incorporated into the surface layer preferably further has a structure represented by the following structural formula (7) (hereinafter sometimes referred to as "structure (7)") for the purpose of adjusting the polarity of the polymer and its compatibility with the resin. When the first polymer has the structure (7), a hydrophobic segment is introduced into the chemical structure of the polymer, and hence the polymer can be localized to the vicinity of the surface of the surface layer and triboelectric charge impartment can be more efficiently performed.

(7)

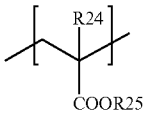

In the structural formula (7), R24 represents a hydrogen atom or a methyl group, and R25 represents a hydrocarbon group having 1 to 18 carbon atoms. R25 preferably represents an alkyl group having 1 to 18 carbon atoms.

Specific examples of a monomer providing the structure represented by the structural formula (7) are given below:

methyl (meth)acrylate, ethyl (meth)acrylate, n-butyl (meth)acrylate, tert-butyl (meth)acrylate, iso-butyl (meth) acrylate, n-amyl (meth)acrylate, n-hexyl (meth)acrylate, cyclohexyl (meth)acrylate, benzyl (meth) acrylate, phenyl (meth)acrylate, 2-ethylhexyl (meth)acrylate, n-octyl (meth) acrylate, iso-octyl (meth)acrylate, isobornyl (meth)acrylate, lauryl (meth)acrylate, and stearyl (meth)acrylate.

The number-average molecular weight of the first polymer to be incorporated into the surface layer is preferably 10,000 or more and 70,000 or less from the viewpoints of its compatibility with a binder resin and its flexibility. In addition, the content of the first polymer in the surface layer is preferably 1 part by mass or more and 20 parts by mass or less with respect to 100 parts by mass of the binder resin in the surface layer.

The surface layer contains the urethane resin functioning as a matrix configured to hold the first polymer in a dispersed state in the surface layer. In addition, the urethane resin has the structure derived from the second polymer containing a fluorine atom or the structure derived from the third polymer containing a fluorine atom and a silicon atom. When the structure derived from the second polymer containing a fluorine atom or the structure derived from the third polymer containing a fluorine atom and a silicon atom is localized to the surface of the surface layer, the structure exhibits a suppressing effect on the adhesion of the toner.

(Urethane Resin Having Structure Derived from Second Polymer Containing Fluorine Atom or Structure Derived from Third Polymer Containing Fluorine Atom and Silicon Atom)

The urethane resin having the structure derived from the second polymer containing a fluorine atom or the structure derived from the third polymer containing a fluorine atom and a silicon atom is obtained by, for example, causing a polymer polyol containing a fluorine atom serving as the second polymer or a polymer polyol containing a fluorine atom and a silicon atom serving as the third polymer and a polyisocyanate to react with each other. Such urethane resin is preferably a thermosetting polyurethane resin because the resin has both compatibility and flexibility. Those urethane resins may be used alone or in combination thereof.

Specific examples of the polyisocyanate are given below:

an aliphatic polyisocyanate, such as ethylene diisocyanate or 1,6-hexamethylene diisocyanate (HDI);

an alicyclic polyisocyanate, such as isophorone diisocyanate (IPDI), cyclohexane 1,3-diisocyanate, or cyclohexane 1,4-diisocyanate;

an aromatic isocyanate, such as 2,4-tolylene diisocyanate, 2,6-tolylene diisocyanate (TDI), 4,4'-diphenylmethane diisocyanate (MDI), polymeric diphenylmethane diisocyanate, xylylene diisocyanate, or naphthalene diisocyanate; and copolymerized products of the above-mentioned isocyanates, isocyanurate forms, trimethylolpropane (TMP) adducts, and biuret forms of the above-mentioned isocyanates, and block forms thereof.

Of those, an aromatic isocyanate, such as tolylene diisocyanate, diphenylmethane diisocyanate, or polymeric diphenylmethane diisocyanate, is preferred.

An example of the second polymer containing a fluorine atom to be caused to react with the polyisocyanate is the polymer polyol containing a fluorine atom. A specific example of the polymer polyol containing a fluorine atom is a polymer of: a fluoroethylene, a (meth)acrylate having a fluoroalkyl group, or a fluoroalkyl vinyl compound; and a monomer having a hydroxy group.

Specific examples of the fluoroethylene include 1-fluoroethylene, 1,1-difluoroethylene, 1,1,2-trifluoroethylene, 1,1,2,2-tetrafluoroethylene, chlorotrifluoroethylene, tetrafluoroethylene, and α,β,β-trifluorostyrene.

Specific examples of the fluoroalkyl (meth)acrylate include 2,2,2-trifluoroethyl (meth)acrylate, 2,2,3,3,3-pentafluoroethyl (meth)acrylate, 2-(perfluoroethyl)ethyl (meth) acrylate, 2-(perfluorobutyl)ethyl (meth)acrylate, 2-(perfluorohexyl)ethyl (meth)acrylate, 1H,1H,3H-tetrafluoropropyl (meth)acrylate, 1H,1H,3H-hexafluorobutyl (meth)acrylate, 1H,1H,5H-octafluoropentyl (meth)acrylate, 1H,1H,7H-dodecafluoro (meth)acrylate, 1H-1-(trifluoromethyl)trifluoroethyl (meth)acrylate, and 1,2,2,2-tetrafluoro-1-(trifluoromethyl)ethyl (meth)acrylate.

Specific examples of the fluoroalkyl vinyl compound include tri fluoromethylethylene, perfluoroethylethylene, 4,4,4-trifluoro-1-butene, perfluorobutylethylene, perfluorohexylethylene, 3-(perfluorobutyl)-1-propene, and 3-(perfluorohexyl)-1-propene.

Specific examples of the monomer having a hydroxy group include: hydroxy group-containing (meth)acrylates, such as hydroxymethyl (meth)acrylate, 2-hydroxyethyl (meth)acrylate, 2-hydroxypropyl acrylate, 3-hydroxypropyl (meth)acrylate, 4-hydroxybutyl (meth)acrylate, 3-hydroxybutyl (meth)acrylate, 6-hydroxyhexyl (meth)acrylate, 8-hydroxyoctyl (meth)acrylate, ethyl 2-(hydroxymethyl) (meth) acrylate, 2-hydroxy-3-phenoxypropyl (meth)acrylate, and 1,4-cyclohexanedimethanol mono(meth)acrylate; and hydroxy group-containing vinyl ethers, such as 2-hydroxyethyl vinyl ether, 3-hydroxypropyl vinyl ether, 4-hydroxybutyl vinyl ether, 6-hydroxyhexyl vinyl ether, diethylene glycol monovinyl ether, and 2-ethyl-1-vinyloxyhexane. Those polymerizable compounds each having a hydroxy group may be used alone or as a mixture thereof.

In the polymer polyol containing a fluorine atom, a radical polymerizable monomer may be polymerized in combination with the above-mentioned monomers. Specific examples of the radical polymerizable monomer include: (meth)acrylates, such as methyl (meth)acrylate, ethyl (meth) acrylate, t-butyl (meth)acrylate, isobutyl (meth)acrylate, n-butyl (meth)acrylate, n-hexyl methacrylate, n-octyl (meth)

acrylate, n-lauryl (meth)acrylate, 2-ethylhexyl (meth)acrylate, and cyclohexyl (meth)acrylate; and vinyl ethers, such as methyl vinyl ether, ethyl vinyl ether, t-butyl vinyl ether, isobutyl vinyl ether, n-butyl vinyl ether, n-hexyl vinyl ether, n-octyl vinyl ether, n-lauryl vinyl ether, 2-ethylhexyl vinyl ether, and cyclohexyl vinyl ether.

As the polyol containing a fluorine atom, a commercial polyol may be used. Specific examples of such polyol are given below: "CEFRAL COAT PX-40", "CEFRAL COAT A202B", "CEFRAL COAT A606X", and "CEFRAL COAT CF803" (all of which are trade names, manufactured by Central Glass Co., Ltd.), "LUMIFLON LF-100", "LUMIFLON LF-200", "LUMIFLON LF-302", "LUMIFLON LF-400", "LUMIFLON LF-554", "LUMIFLON LF-600", and "LUMIFLON LF-986N" (all of which are trade names, manufactured by AGC Asahi Glass), "ZAFLON FC-110", "ZAFLON FC-220", "ZAFLON FC-250", "ZAFLON FC-275", "ZAFLON FC-310", "ZAFLON FC-575", and "ZAFLON XFC-973" (all of which are trade names, manufactured by Toagosei Co., Ltd.), "ZEFFLE GK-510" (trade name, manufactured by Daikin Industries, Ltd.), and FLUONATE series (trade name, manufactured by Dainippon Ink and Chemicals, Inc.).

Examples of the third polymer containing a fluorine atom and a silicon atom to be caused to react with the polyisocyanate include: the polymer polyol containing a fluorine atom and a silicon atom; and a fluorine resin that is obtained by grafting a group containing a siloxane, such as dimethylsiloxane, and has a plurality of hydroxy groups (hereinafter sometimes simply referred to as "silicone-grafted fluorine resin").

The polymer polyol containing a fluorine atom and a silicon atom may be prepared by a known method. For example, the polyol is obtained by polymerizing: a fluoroethylene, a (meth)acrylate having a fluoroalkyl group, or a fluoroalkylvinyl compound; a (meth)acrylate having a silicone group; and a monomer having a hydroxy group. The compounds described in the foregoing may be used as the fluoroethylene, the (meth)acrylate having a fluoroalkyl group, the fluoroalkylvinyl compound, and the monomer having a hydroxy group.

The (meth)acrylate having a silicone group is, for example, a polymerizable compound having a siloxane bond on a side chain thereof. Various commercial products may each be used as the polymerizable compound having a siloxane bond on a side chain thereof. For example, the following commercial products may each be used as a one-terminal modified dimethylpolysiloxane. Examples thereof may include "SILAPLANE FM-0711" and "SILAPLANE FM-0725" (trade names, manufactured by JNC Corporation), and "X22-174DX" (trade name, manufactured by Shin-Etsu Chemical Co., Ltd.). Those polymerizable compounds each having a siloxane bond on a side chain thereof may be used alone or as a mixture thereof.

The number-average molecular weight of the grafted silicone portion of the silicone-grafted fluorine resin is preferably 10,000 or more and 50,000 or less, more preferably 15,000 or more and 30,000 or less. When the number-average molecular weight of the silicone portion falls within the range, the urethane resin obtained by causing the resin and the polyisocyanate to react with each other can provide a surface layer exhibiting a higher suppressing effect on the adhesion of the toner. The silicone-grafted fluorine resin may be prepared by a known method.

In addition, as the silicone-grafted fluorine resin, commercial products, such as "ZX-001", "ZX-007-C", "ZX-017", "ZX-022", "ZX-022-C", and "ZX-022-H" (all of which are trade names, manufactured by T&K Toka Co., Ltd.), may be used.

A resin having the structure derived from the third polymer containing a fluorine atom and a silicon atom is more preferred as the urethane resin. Of such resins, a urethane resin including a structure derived from the above-mentioned silicone-grafted fluorine resin is preferred because the resin can provide a surface layer having the following features: the property by which dirt adheres to its surface is extremely low; and its triboelectric charge imparting ability to the toner hardly changes even after long-term formation of an electrophotographic image.

In addition, in order that the compatibility of the urethane resin with the first polymer in the region from a depth of 100 nm from the outer surface of the surface layer to a depth of 300 nm may be improved, in addition to at least one of the second polymer or the third polymer, for example, a polymer polyol free of a fluorine atom and a silicon atom serving as a fourth polymer may be used as a raw material for the urethane resin.

As such polymer polyol, a known polyether polyol, polyester polyol, or polycarbonate polyol may be used.

Specific examples of the polyether polyol include polyethylene glycol, polypropylene glycol, and polytetramethylene glycol.

An example of the polyester polyol is the following:

a polyester polyol obtained by a condensation reaction between: a diol component, such as 1,4-butanediol, 3-methyl-1,4-pentanediol, or neopentyl glycol, or a triol component, such as trimethylolpropane; and a dicarboxylic acid, such as adipic acid, phthalic anhydride, terephthalic acid, or hexahydroxyphthalic acid.

An example of the polycarbonate polyol is the following:

a polycarbonate polyol obtained by a condensation reaction between: a diol component, such as 1,3-propanediol, 1,4-butanediol, 1,6-hexanediol, 3-methyl-1,5-pentanediol, diethylene glycol, polyethylene glycol, polypropylene glycol, or polytetramethylene glycol; and phosgene, a dialkyl carbonate, such as dimethyl carbonate, or a cyclic carbonate, such as ethylene carbonate.

Each of those polyol components may be converted to a prepolymer having its chain extended in advance with an isocyanate, such as 2,4-tolylene diisocyanate (TDI), 1,4-diphenylmethane diisocyanate (MDI), or isophorone diisocyanate (IPDI), as required.

The polymer polyol serving as the fourth polymer is preferably mixed at a ratio of from 0.9 mol to 50.0 mol when the total number of moles of the polymer polyol containing a fluorine atom serving as the second polymer and the polymer polyol containing a fluorine atom and a silicon atom serving as the third polymer is set to 1.0 mol.

When the mixing ratio of the fourth polymer with respect to the polyols according to the second polymer and the third polymer is set within the range, the urethane resin to be obtained can provide a surface layer that causes a more uniform charge quantity distribution of the toner and is more excellent in suppressing effect on the adhesion of the toner.

The polymer polyols and the polyisocyanate are preferably mixed so that the ratio (molar ratio) of an isocyanate group may fall within the range of from 1.0 to 4.5 with respect to 1.0 of a hydroxy group from the viewpoint of suppressing the remaining of an unreacted component.

In addition to the thermosetting reaction involving using the isocyanate compound, a method of obtaining the thermosetting polyurethane resin may be, for example, a method involving curing a compound having a vinyl group or an acryloyl group introduced into a terminal thereof instead of the polyols with UV light or an electron beam. In a curing system involving using the UV light or the electron beam, a curing reaction can be completed in a time period shorter than that in a curing system involving using the isocyanate compound.

The surface layer according to this embodiment may be produced through, for example, the following steps (I) to (III):

(I) a step of preparing a paint for forming a surface layer containing the following components (a1), (a2), and (a4), or the following components (a1) to (a4):

(a1) the first polymer;

(a2) one or both of the polymer polyol containing a fluorine atom (second polymer) and the polymer polyol containing a fluorine atom and a silicon atom (third polymer);

(a3) the polymer polyol free of a fluorine atom and a silicon atom (hereinafter sometimes referred to as "fourth polymer"); and (a4) the polyisocyanate;

(II) a step of forming a layer of the paint for forming a surface layer on the surface of the electro-conductive substrate or the surface of the elastic layer; and (III) a step of curing the layer of the paint for forming a surface layer.

Here, in the layer formed in the step (II), the component (a2) migrates toward the outer surface of the layer, and in a portion deep from the outer surface of the layer, the component (a1) and the component (a3) are abundantly present. Then, after the layer has been subjected to the step (III), the surface layer according to this embodiment satisfying the relationships represented by the expression (1) and the expression (2) can be obtained.

That is, the surface layer may be defined as a cured product of the paint for forming a surface layer containing the components (a1), (a2), and (a4), or the components (a1) to (a4).

Any other resin except the urethane resin having one or both of the structure derived from the second polymer and the structure derived from the third polymer, and various additives, such as an electro-conductivity-imparting agent, a non-electro-conductive filler, a crosslinking agent, and a catalyst, may be blended into the surface layer to the extent that an object of blending any such component is achieved and the effects of the present invention are not impaired. The other resin is not particularly limited and a known resin may be used, but examples thereof include the following resins: a polyester resin, a polyether resin, an acrylic resin, an epoxy resin, or an amino resin such as melamine, an amide resin, an imide resin, an amide imide resin, a phenol resin, a vinyl resin, a silicone resin, and a polyalkylene imine resin. Those resins may be used alone or in combination thereof. In addition, examples of the additives, such as the electro-conductivity-imparting agent, may include the same materials as those listed in the elastic layer. The thickness of the surface layer is preferably from 1 μm to 50 μm, more preferably from 5 μm to 30 μm.

An electrophotographic apparatus and a process cartridge to which the electrophotographic member according to the present invention is applicable are described below.

<Electrophotographic Apparatus>

The electrophotographic member according to one aspect of the present invention can be suitably used as a developing roller, a charging roller, a toner-supplying roller, a developing blade, and a cleaning blade in the electrophotographic apparatus. The electrophotographic member according to the present invention is applicable to any one of, for example, a noncontact-type developing apparatus and a contact-type developing apparatus each using a magnetic one-component developer or a nonmagnetic one-component developer, and a developing apparatus using a two-component developer.

The electrophotographic apparatus includes a photosensitive member, and at least one of a charging roller, a developing roller, or a developing blade. FIG. 3 is a schematic sectional view for illustrating an example of the electrophotographic apparatus in which the electrophotographic member according to the present invention is mounted as the developing roller of a contact-type developing apparatus using a one-component toner. As illustrated in FIG. 3, a developing apparatus 22 includes: a toner container 20 storing a toner 20*a* serving as a one-component developer; a developing roller 11; a toner-supplying roller 19 configured to supply the toner to the developing roller 11; and a developing blade 21 configured to regulate the thickness of a toner layer on the developing roller 11. The developing roller 11 is positioned in an opening portion extending in a longitudinal direction in the toner container 20, and is arranged so as to be brought into contact with a photosensitive member 18. The photosensitive member 18, a cleaning blade 26, a waste toner-storing container 25, and a charging roller 24 may be arranged in the main body of the electrophotographic apparatus.

The printing operation of the electrophotographic apparatus is described below. The photosensitive member 18 rotates in a direction indicated by the arrow, and is uniformly charged by the charging roller 24 for subjecting the photosensitive member 18 to a charging treatment. Next, an electrostatic latent image is formed on the surface of the photosensitive member 18 by laser light 23 serving as an exposing unit for writing the electrostatic latent image on the photosensitive member. The electrostatic latent image is developed by the developing apparatus 22 through the application of the toner 20*a* from the developing roller 11 arranged so as to be brought into contact with the photosensitive member 18, and is visualized as a toner image. In the electrophotographic apparatus, the so-called reversal development in which the toner image is formed in an exposing portion is performed. The visualized toner image on the photosensitive member 18 is transferred onto paper 34 serving as a recording medium by a transfer roller 29 serving as a transfer member. The paper 34 is fed into the apparatus through a sheet-feeding roller 35 and an adsorption roller 36, and is conveyed into a gap between the photosensitive member 18 and the transfer roller 29 by an endless belt-shaped transfer conveyance belt 32.

The transfer conveyance belt 32 is operated by a driven roller 33, a driving roller 28, and a tension roller 31. A voltage is applied from a bias power source 30 to each of the transfer roller 29 and the adsorption roller 36. The paper 34 onto which the toner image has been transferred is subjected to a fixing treatment by a fixing apparatus 27, and then discharged to the outside of the apparatus. Thus, the printing operation is completed. Meanwhile, transfer residual toner remaining on the photosensitive member 18 without being transferred is scraped off by the cleaning blade 26 serving as a cleaning member for cleaning the surface of the photosensitive member and is stored in the waste toner-storing container 25. The cleaned photosensitive member 18 repeatedly performs the above-mentioned printing operation.

<Process Cartridge>

The electrophotographic member according to one aspect of the present invention may be suitably used as each of a developing roller, a charging roller, a toner-supplying roller, a developing blade, and a cleaning blade in a process cartridge. The process cartridge includes at least one of the charging roller, the developing roller, or the developing blade.

Figure 4:
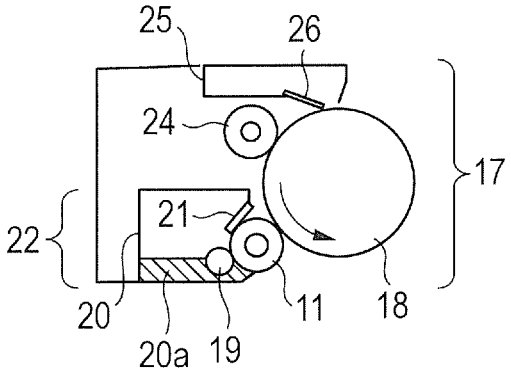
FIG. 4 is a schematic construction view for illustrating a process cartridge according to one aspect of the present invention.

FIG. 4 is a schematic sectional view for illustrating an example of the process cartridge. A process cartridge 17 illustrated in FIG. 4 is removably mounted onto the main body of an electrophotographic apparatus. The process cartridge 17 is obtained by integrating the developing apparatus 22, which includes the developing roller 11 and the developing blade 21, the photosensitive member 18, the cleaning blade 26, the waste toner-storing container 25, and the charging roller 24. The developing apparatus 22 further includes the toner container 20, and the toner 20*a* is loaded into the toner container 20. The toner 20*a* in the toner container 20 is supplied to the surface of the developing roller 11 by the toner-supplying roller 19, and a layer of the toner 20*a* having a predetermined thickness is formed on the surface of the developing roller 11 by the developing blade 21.

The electrophotographic member according to the present invention can be used as at least one kind of the developing roller or the developing blade in each of the electrophotographic apparatus and the process cartridge. The developing roller in each of the electrophotographic apparatus and the process cartridge is particularly required to have uniform and stable electro-conductivity even when its use environment changes, but the electrophotographic member of the present invention is preferably used as such developing roller.

According to one aspect of the present invention, there can be obtained an electrophotographic member that can provide a high-quality electrophotographic image even when used as a developing member under a high-temperature and high-humidity environment. In addition, according to another aspect of the present invention, there are obtained a process cartridge and an electrophotographic apparatus conducive to stable output of high-quality electrophotographic images.

Now, specific Examples and Comparative Examples according to the present invention are described.

<Synthesis of First Polymer>

[Synthesis of Monomer]

(Synthesis of Monomer No. A-1)

In an autoclave including a rotation mechanism, 130.5 g of dimethylaminoethyl methacrylate (trade name: LIGHT ESTER DM, manufactured by Kyoeisha Chemical Co., Ltd.) serving as a reactive species 1 and 119.5 g of n-butyl bromide (manufactured by Tokyo Chemical Industry Co., Ltd.) serving as a reactive species 2 were added to 500 g of dry tetrahydrofuran, and the mixture was subjected to a reaction at a temperature of 60° C. for 3 hours. Next, the reaction mixture was cooled to 5° C., and the solvent was removed by distillation under reduced pressure. Thus, 2-(methacryloyloxy)ethyl-N-n-butyl-N,N-dimethylammonium bromide (monomer No. A-1) was obtained.

(Synthesis of Monomers Nos. A-2 to A-6)

Monomers Nos. A-2 to A-6 were synthesized in the same manner as in the method of synthesizing the monomer No. A-1 except that the reactive species and their blending amounts were changed as shown in Table 1. The compound names of the monomers Nos. A-2 to A-6 are as described below.

(Monomer No. A-2): 2-(methacryloyloxy)ethyl-N-lauryl-N,N-dimethylammonium bromide (Monomer No. A-3): 2-(methacryloyloxy)ethyl-N,N-dimethyl-N-stearylammonium bromide (Monomer No. A-4): 3-methyl-1-vinylimidazolium bromide (Monomer No. A-5): 2-(3-buten-1-yl)-1-ethyl-3-tridecylimidazolium bromide (Monomer No. A-6): 1-methyl-4-vinylpyridinium bromide

TABLE 1

| | Reactive species 1 | | Reactive species 2 | |
|---|---|---|---|---|
| Monomer No. | Material name | Blending amount (g) | Material name | Blending amount (g) |
| A-1 | Dimethylaminoethyl methacrylate "LIGHT ESTER DM" (trade name, manufactured by Kyoeisha Chemical Co., Ltd.) | 130.5 | n-Butyl bromide (manufactured by Tokyo Chemical Industry Co., Ltd.) | 119.5 |
| A-2 | Dimethylaminoethyl methacrylate "LIGHT ESTER DM" (trade name, manufactured by Kyoeisha Chemical Co., Ltd.) | 93.8 | Lauryl bromide (manufactured by Tokyo Chemical Industry Co., Ltd.) | 156.2 |
| A-3 | Dimethylaminoethyl methacrylate "LIGHT ESTER DM" (trade name, manufactured by Kyoeisha Chemical Co., Ltd.) | 77.5 | Stearyl bromide (manufactured by Tokyo Chemical Industry Co., Ltd.) | 172.5 |
| A-4 | 1-Vinylimidazole (manufactured by Tokyo Chemical Industry Co., Ltd.) | 121.3 | Methyl bromide (manufactured by Tokyo Chemical Industry Co., Ltd.) | 138.7 |
| A-5 | 2-(3-Buten-1-yl)-1-ethyl-1H-imidazole (manufactured by UORSY) | 87.2 | Tridecane bromide (manufactured by Sigma-Aldrich) | 162.8 |

TABLE 1-continued

| Monomer No. | Reactive species 1 Material name | Reactive species 1 Blending amount (g) | Reactive species 2 Material name | Reactive species 2 Blending amount (g) |
|---|---|---|---|---|
| A-6 | 4-Vinylpyridine (manufactured by Tokyo Chemical Industry Co., Ltd.) | 103.3 | Methyl bromide (manufactured by Tokyo Chemical Industry Co., Ltd.) | 146.7 |

(Synthesis of Monomer No. A-7)

In an autoclave including a rotation mechanism, 81.3 g of 3-methyl-5-(2-propen-1-yl)pyridine (manufactured by Aurora Fine Chemicals) and 168.7 g of tridecane bromide (manufactured by Sigma-Aldrich) were added to 500 g of dry tetrahydrofuran, and the mixture was subjected to a reaction at a temperature of 60° C. for 3 hours.

Next, the reaction mixture was cooled to 5° C., and the solvent was removed by distillation under reduced pressure. Thus, 3-methyl-5-(2-propen-1-yl)-1-tridecylpyridinium bromide was obtained.

Purified water of 100 mL was added to the resultant reaction product, and the whole was stirred for 1 hour.

Next, 65.7 g of sodium p-toluenesulfonate (manufactured by Tokyo Chemical Industry Co., Ltd.) was dissolved in 100 mL of purified water, and the solution was stirred for 1 hour. Next, those two kinds of aqueous solutions were mixed, and the mixture was stirred for 3 hours. After the solutions had been mixed and stirred, the resultant mixture was left to stand overnight. Thus, the mixture was separated into two layers, i.e., an aqueous layer and an oil layer containing a p-toluenesulfonate of 3-methyl-5-(2-propen-1-yl)-1-tridecylpyridinium. After the oil layer had been recovered with a separating funnel, the recovered oil layer was washed with purified water and filtered; the washing and the filtration were each repeated twice to remove sodium bromide remaining in the oil layer. Thus, the p-toluenesulfonate of 3-methyl-5-(2-propen-1-yl)-1-tridecylpyridinium (monomer No. A-7) was obtained.

[Synthesis of First Polymer]

(Synthesis of Polymer No. B-1)

Dry methyl ethyl ketone of 150.0 parts by mass was loaded into a reaction vessel including a stirrer, a temperature gauge, a reflux tube, a dropping apparatus, and a nitrogen gas-introducing tube. In a stream of a nitrogen gas, a temperature in the vessel was increased to 87° C., and methyl ethyl ketone was heated to reflux. Next, a mixture of 42.4 parts by mass of dimethylaminoethyl methacrylate (trade name: LIGHT ESTER DM, manufactured by Kyoeisha Chemical Co., Ltd.), 7.6 parts by mass of n-lauryl methacrylate (trade name: LIGHT ESTER L, manufactured by Kyoeisha Chemical Co., Ltd.), and 0.3 part by mass of an initiator (trade name: KAYAESTER O, manufactured by Kayaku Akzo Corporation) was gradually dropped into the vessel over 1 hour. The temperature was held at 87° C., and the resultant mixture was further heated to reflux for 3 hours. Next, the temperature was reduced to 50° C., and then 100.0 parts by mass of methyl ethyl ketone was removed by distillation under reduced pressure. The residue was cooled to room temperature to provide a polymer No. B-1 having the structures (1) and (7).

(Synthesis of Polymers Nos. B-2 to B-18)

Polymers Nos. B-2 to B-18 were obtained by performing the same operation as that of the synthesis example of the polymer No. B-1 except that the monomer species and their mixing ratio were changed as shown in Table 2.

TABLE 2

| Polymer No. | First monomer Structure | First monomer Monomer species | First monomer Part(s) by mass | Second monomer Structure | Second monomer Monomer species | Second monomer Part(s) by mass | Third monomer Structure | Third monomer Monomer species | Third monomer Part(s) by mass |
|---|---|---|---|---|---|---|---|---|---|
| B-1 | (1) | Dimethylaminoethyl methacrylate (trade name: LIGHT ESTER DM, manufactured by Kyoeisha Chemical Co., Ltd.) | 42.4 | (7) | n-Lauryl methacrylate (trade name: LIGHT ESTER L, manufactured by Kyoeisha Chemical Co., Ltd.) | 7.6 | — | — | — |
| B-2 | (1) | Dimethylaminoethyl acrylate (trade name: ARON DA, manufactured by Toagosei Co., Ltd.) | 41.8 | (7) | | 8.2 | — | — | — |
| B-3 | (1) | Diethylaminoethyl methacrylate (trade name: LIGHT ESTER DE, manufactured by Kyoeisha Chemical Co., Ltd.) | 43.4 | (7) | | 6.6 | — | — | — |
| B-4 | (1) | Dimethylaminoethyl methacrylate | 46.7 | (7) | Methyl acrylate (manufactured by Mitsubishi Chemical Corporation) | 3.3 | — | — | — |

TABLE 2-continued

| Polymer No. | First monomer Structure | First monomer Monomer species | First monomer Part(s) by mass | Second monomer Structure | Second monomer Monomer species | Second monomer Part(s) by mass | Third monomer Structure | Third monomer Monomer species | Third monomer Part(s) by mass |
|---|---|---|---|---|---|---|---|---|---|
| B-5 | (2) | Monomer No. A-1 | 26.8 | (7) | n-Lauryl | 23.2 | — | — | — |
| B-6 | (2) | Monomer No. A-2 | 30.8 | (7) | methacrylate | 19.2 | — | — | — |
| B-7 | (2) | Monomer No. A-3 | 41.5 | (7) | Methyl acrylate | 8.5 | — | — | — |
| B-8 | (1) | Dimethylaminoethyl methacrylate | 8.4 | (2) | Monomer No. A-3 | 26.2 | (7) | n-Stearyl methacrylate (trade name: LIGHT ESTER S, manufactured by Kyoeisha Chemical Co., Ltd.) | 15.5 |
| B-9 | (2) | Monomer No. A-1 | 28.1 | (3) | 2-Methyl-1-vinylimidazole (manufactured by Tokyo Chemical Industry Co., Ltd.) | 10.3 | (7) | n-Butyl methacrylate (trade name: LIGHT ESTER NB, manufactured by Kyoeisha Chemical Co., Ltd.) | 11.6 |
| B-10 | (3) | 2-Methyl-1-vinylimidazole | 14.9 | (7) | n-Lauryl methacrylate | 35.1 | — | — | — |
| B-11 | (3) | 1-(6-Hepten-1-yl)-1H-imidazole (manufactured by UORSY) | 19.6 | (7) | | 30.4 | — | — | — |
| B-12 | (4) | 3-(2-Methyl-2-propen-1-yl)pyridine (manufactured by FCF) | 17.2 | (7) | | 32.8 | — | — | — |
| B-13 | (4) | 3-Methyl-5-(2-propen-1-yl)pyridine (manufactured by Aurora Fine Chemicals) | 17.2 | (7) | | 32.8 | — | — | — |
| B-14 | (5) | Monomer No. A-4 | 43.5 | (7) | n-Lauryl | 6.5 | — | — | — |
| B-15 | (5) | Monomer No. A-5 | 46.8 | (7) | methacrylate | 3.2 | — | — | — |
| B-16 | (6) | Monomer No. A-6 | 29.0 | (7) | n-Stearyl methacrylate | 21.0 | — | — | — |
| B-17 | (6) | Monomer No. A-7 | 44.5 | (7) | n-Butyl methacrylate | 5.5 | — | — | — |
| B-18 | (3) | 2-Methyl-1-vinylimidazole | 50.0 | — | — | — | — | — | — |

<Synthesis of Binder Resin>

(Synthesis of Isocyanate Group-Terminated Prepolymer C-1)

Under a nitrogen atmosphere, 100.0 parts by mass of PTG-L1000 (trade name, manufactured by Hodogaya Chemical Co., Ltd.) was gradually dropped to 79.1 parts by mass of polymeric MDI (trade name: MILLIONATE (trademark) MR-200, manufactured by Tosoh Corporation) in a reaction vessel while a temperature in the reaction vessel was held at 65° C. After the completion of the dropping, the mixture was subjected to a reaction at a temperature of 65° C. for 3 hours, and 80.0 parts by mass of methyl ethyl ketone was added to the resultant. The resultant reaction mixture was cooled to room temperature to provide an isocyanate group-terminated urethane prepolymer C-1 having an isocyanate group content of 5.5 mass %.

(Synthesis of Isocyanate Group-Terminated Prepolymer C-2)

Under a nitrogen atmosphere, 100.0 parts by mass of Kuraray Polyol C-1090 (trade name, manufactured by Kuraray Co., Ltd.) was gradually dropped to 81.4 parts by mass of polymeric MDI (trade name: MILLIONATE MR-200, manufactured by Tosoh Corporation) in a reaction vessel while a temperature in the reaction vessel was held at 65° C. After the completion of the dropping, the mixture was subjected to a reaction at a temperature of 65° C. for 3 hours, and 80.0 parts by mass of methyl ethyl ketone was added to the resultant. The resultant reaction mixture was cooled to room temperature to provide an isocyanate group-terminated urethane prepolymer C-2 having an isocyanate group content of 5.8 mass %.

<Synthesis of Resin Having Structure Derived from Polymer Dontaining Fluorine Atom and Silicon Atom (Third Polymer)>

(Synthesis of Silicone-Grafted Fluorine Resin D-1)

First, "LUMIFLON LF-200" (trade name, manufactured by Asahi Glass Co., Ltd.) was prepared as a polyol containing a fluorine atom.

Next, a vinyl group was introduced as a radical polymerizable group into the polyol by the following method.

That is, in a glass reaction vessel including a mechanical stirrer, a temperature gauge, a condenser, and a dry nitrogen gas-introducing port, 100.0 g of the "LUMIFLON LF-200" was dissolved in 100.0 g of methyl ethyl ketone under a dry nitrogen atmosphere. Then, a solution obtained by dissolving 1.7 g (0.02 mol) of allyl isocyanate (manufactured by Sigma-Aldrich) in 5 g of methyl ethyl ketone was gradually dropped into the solution while a temperature in the reaction vessel was held at 80° C.

After the completion of the dropping, the mixture was subjected to a reaction at a temperature of 80° C. for 2 hours so that the hydroxy group on the side chain of the "LUMIFLON LF-200" and the isocyanate group of allyl isocyanate were caused to react with each other. The resultant reaction mixture was cooled to room temperature. Thus, 73.1 g of a polyol having a vinyl group and containing a fluorine atom was obtained.

Next, a polymerizable compound having a siloxane bond on a side chain thereof was synthesized. Trimethylsilanol (manufactured by Tokyo Chemical Industry Co., Ltd.) of 0.5 g was loaded into a glass reaction vessel including a mechanical stirrer and a dropping funnel, and was stirred in an ice bath. Subsequently, 3.6 mL of a solution of n-butyllithium in hexane (1.6 mol/L, manufactured by Tokyo Chemical Industry Co., Ltd.) was dropped into the compound. After the completion of the dropping, the mixture was stirred in the ice bath for 1 hour, and then a solution obtained by dissolving 24.66 g of hexamethylcyclotrisiloxane (manufactured by Tokyo Chemical Industry Co., Ltd.) in 25 g of tetrahydrofuran was gradually dropped into the mixture. After the completion of the dropping, the ice bath was removed and the resultant mixture was stirred for 6 hours. Chlorodimethylvinylsilane (manufactured by Tokyo Chemical Industry Co., Ltd.) of 1.0 g was dropped into the mixture, and the whole was further stirred for 12 hours. Then, a 10 mass % aqueous solution of sodium hydrogen carbonate was added to the resultant reaction solution, and an aqueous layer was removed. Thus, an organic layer was obtained. The organic layer was washed with pure water, and was then dehydrated with magnesium sulfate (manufactured by Umai Chemical Co., Ltd.) so that a volatile component was removed under the condition of 50° C./10 mmHg.

Thus, 25.0 g of a terminal vinyl-modified polydimethylsiloxane S-1 having a vinyl group on one terminal of dimethylsiloxane was obtained. The number-average molecular weight (Mn) of the resultant terminal vinyl-modified polydimethylsiloxane was measured under the following conditions.

Apparatus: HLC-8120GPC (trade name, manufactured by Tosoh Corporation)

Column: TSKgel SuperHZMM (trade name, manufactured by Tosoh Corporation)×2 columns Solvent: toluene Temperature: 40° C.

Flow rate of THF: 0.6 mL/min

A measurement sample was a 0.1 mass % toluene solution. Further, the measurement was performed by using a refractive index (RI) detector as a detector. In addition, a calibration curve was created by using TSK standard polystyrenes (trade name: "A-1000", "A-2500", "F-1", "F-2", "F-4", "F-10", "F-20", "F-80", and "F-128", manufactured by Tosoh Corporation) as standard samples for creating the calibration curve. The number-average molecular weight was determined from the resultant retention time of the measurement sample based on the created calibration curve. The number-average molecular weight of the terminal vinyl-modified polydimethylsiloxane S-1 was 15,000.

Next, materials shown in Table 3 below were loaded into a glass reaction vessel including a mechanical stirrer, a temperature gauge, a condenser, and a dry nitrogen gas-introducing port.

TABLE 3

| Material | Blending amount (g) |
|---|---|
| The above-mentioned polyol having a vinyl group and containing a fluorine atom | 20.0 |
| Xylene | 18.3 |
| n-Butyl acetate | 15.2 |

TABLE 3-continued

| Material | Blending amount (g) |
|---|---|
| Methyl methacrylate (manufactured by Mitsubishi Gas Chemical Company, Inc.) | 2.1 |
| n-Butyl methacrylate (trade name: LIGHT ESTER NB, manufactured by Kyoeisha Chemical Co., Ltd.) | 1.6 |
| Lauryl methacrylate (trade name: LIGHT ESTER L, manufactured by Kyoeisha Chemical Co., Ltd.) | 1.6 |
| 2-Hydroxyethyl methacrylate (trade name: LIGHT ESTER HO-250 (N), manufactured by Kyoeisha Chemical Co., Ltd.) | 1.6 |
| Terminal vinyl-modified polydimethylsiloxane S-1 | 4.8 |
| Radical polymerization initiator (trade name: Perbutyl O, manufactured by Nippon Oil & Fats Co., Ltd.) | 0.1 |

Then, under a nitrogen atmosphere, the materials were subjected to a reaction at a temperature of 90° C. for 4 hours. The resultant reaction mixture was cooled to room temperature. Thus, a vinyl group in the polyol having a vinyl group and containing a fluorine atom, and the terminal vinyl-modified polydimethylsiloxane S-1 and the methacrylates were caused to react with each other. Thus, 31 g of a hydroxy group-containing silicone-grafted fluorine resin D-1 was obtained. The number-average molecular weight (Mn) of the hydroxy group-containing silicone-grafted fluorine resin D-1 was measured in the same manner as in the terminal vinyl-modified polydimethylsiloxane S-1. As a result, the number-average molecular weight was 20,000.

<Production of Developing Roller>

EXAMPLE 1

(Preparation of Substrate)

A product obtained by applying a primer (trade name: DY35-051, manufactured by Dow Corning Toray Co., Ltd.) to a mandrel made of stainless steel (SUS304) having a diameter of 6 mm and baking the primer in an oven heated to a temperature of 180° C. for 20 minutes was prepared as a substrate.

(Formation of Elastic Layer)

The substrate was placed in a mold, and an addition-type silicone rubber composition obtained by mixing the materials shown in Table 4 was injected into a cavity formed in the mold.

TABLE 4

| | |
|---|---|
| Liquid silicone rubber material (trade name: SE 6905 A/B, manufactured by Dow Corning Toray Co., Ltd.) | 100 parts by mass |
| Carbon black (trade name: DENKA BLACK (trademark) powdery product, manufactured by Denki Kagaku Kogyo Kabushiki Kaisha) | 10 parts by mass |
| Heat resistance-imparting agent (silica powder) | 5.0 parts by mass |
| Platinum catalyst | 0.1 part by mass |

The mold was heated at 150° C. for 15 minutes, and the silicone rubber composition was vulcanized and cured. The substrate having a cured silicone rubber layer formed on its peripheral surface was removed from the mold, and then the curing reaction of the silicone rubber layer was completed by further heating at a temperature of 180° C. for 1 hour. Thus, an elastic roller in which a silicone rubber elastic layer having a diameter of 12 mm had been formed on the outer periphery of the substrate was produced.

(Preparation of Paint for Forming Surface Layer)

Methyl ethyl ketone was added to a mixture of the materials shown in Table 5 so as to achieve a total solid content ratio of 30 mass %, and then the contents were mixed in a sand mill. Then, the viscosity of the mixture was further adjusted to from 10 cps to 12 cps with methyl ethyl ketone. Thus, a paint for forming a surface layer according to Example 1 was prepared.

TABLE 5

| Material | Blending amount (part(s) by mass) |
|---|---|
| Polyol (trade name: PTG-L1000; manufactured by Hodogaya Chemical Co., Ltd.) | 36.9 |
| Isocyanate group-terminated prepolymer C-1 | 78.6 |
| Carbon black (trade name: MA230; manufactured by Mitsubishi Chemical Corporation) | 20.0 |
| Urethane resin particles (trade name: Art Pearl C-400; manufactured by Negami Chemical Industrial Co., Ltd.) | 15.0 |
| Polymer No. B-1 | 5.0 |
| Silicone-grafted fluorine resin (trade name: ZX-007-C; manufactured by T&K Toka Co., Ltd.) | 1.0 |

(Production of Developing Roller)

A coating film of the paint for forming a surface layer according to Example 1 was formed on the surface of the elastic layer of the elastic roller produced in advance by immersing the elastic roller in the paint, and was dried. Further, the resultant was subjected to a heat treatment at a temperature of 150° C. for 1 hour. Thus, a developing roller according to Example 1 having a surface layer having a thickness of about 15 μm formed on the outer periphery of the elastic layer 4 was obtained. The surface layer of the developing roller according to Example 1 contains, as the first polymer, the polymer No. B-1 having the structures (1) and (7).

The ratio Nn of the total number of nitrogen atoms derived from the structure (1) to the total number of atoms measured by X-ray photoelectron spectroscopy (ESCA) in a region from the outer surface of the surface layer to a depth of 300 nm was measured for the resultant developing roller according to Example 1. In addition, the ratio Nna of the total number of nitrogen atoms derived from the structure (1) in a region from a depth of 100 nm from the outer surface of the surface layer to a depth of 300 nm, and the sum (Fna+Sina) of the ratio of the number of fluorine atoms derived from the urethane resin (silicone-grafted fluorine resin) in the region and the ratio of the number of silicon atoms derived therefrom were measured. In addition, the ratio Nnb of the total number of nitrogen atoms derived from the structure (1) in a region from the outer surface of the surface layer to a depth of 10 nm, and the sum (Fnb+Sinb) of the ratio of the number of fluorine atoms derived from the urethane resin (silicone-grafted fluorine resin) in the region and the ratio of the number of silicon atoms derived therefrom were measured. The (Fnb+Sinb) is the sum of the ratios of the numbers of the fluorine atoms and the silicon atoms when the measurement is performed under a state in which the surface is not etched. The results are collectively shown in Table 12.

A scanning X-ray photoelectron spectrometer (trade name: Quantum 2000; manufactured by ULVAC-PHI, Inc.) was used in the measurement, and etching and analysis were performed under the following conditions.

[Etching Conditions]

Sputtering ion: C60 (fullerene) ion

Sputtering acceleration voltage: 4 kV

Raster size: 2×0.5 $mm^2$

[ESCA Analysis Conditions]

X-ray source: Al Kα

X-ray setting: φ100 μm (15 kV, 25 W)

Photoelectron takeoff angle: 45°

Neutralization condition: combination use of a neutralization gun and an ion gun Analysis region: φ100 μm Pass energy: 23.5 eV Step size: 0.1 eV

EXAMPLES 2 TO 11

Paints for forming surface layers according to Examples 2 to 11 were prepared in the same manner as in Example 1 except that the kinds and blending amounts of the first polymer and the polymer polyol in the paint for forming a surface layer according to Example 1 were changed as shown in Table 9. Developing rollers according to the respective examples were produced in the same manner as in Example 1 except that the paints for forming surface layers according to the respective examples were used.

EXAMPLE 12

A paint for forming a surface layer according to this example was prepared in the same manner as in the paint for forming a surface layer according to Example 1 except that the mixture used in the preparation of the paint for forming a surface layer according to Example 1 was changed to a mixture of materials shown in Table 6. A developing roller was produced in the same manner as in Example 1 except that this paint for forming a surface layer was used.

TABLE 6

| Material | Blending amount (parts by mass) |
|---|---|
| Polycarbonate polyol (trade name: Kuraray Polyol C-2090; manufactured by Kuraray Co., Ltd.) | 55.3 |
| Isocyanate group-terminated prepolymer C-2 | 55.9 |
| Carbon black (trade name: MA230; manufactured by Mitsubishi Chemical Corporation) | 20.0 |
| Urethane resin particles (trade name: Art Pearl C-400; manufactured by Negami Chemical Industrial Co., Ltd.) | 15.0 |
| Polymer No. B-6 | 7.0 |
| Silicone-grafted fluorine resin (trade name: ZX-007-C; manufactured by T&K Toka Co., Ltd.) | 5.0 |

"Kuraray Polyol C-2090" is a polycarbonate polyol derived from 3-methyl-1,5-pentanediol and 1,6-hexanediol, and has a weight-average molecular weight of 2,000.

EXAMPLES 13 TO 25

The kinds and blending amounts of the first polymer and the polymer polyol in the paint for forming a surface layer according to Example 12 were changed as shown in Table 10. Paints for forming surface layers according to Examples 13 to 25 were prepared in the same manner as in the paint for forming a surface layer according to Example 12 except the foregoing. Then, developing rollers according to the respective examples were produced in the same manner as in Example 12 except that the paints for forming surface layers according to the respective examples were used.

EXAMPLES 26 AND 27

Developing rollers were produced in the same manner as in Example 24 except that the silicone-grafted fluorine resin ("ZX-007-C") was changed to a polymer polyol containing a fluorine atom (trade name: LUMIFLON LF-200; manufactured by Asahi Glass Co., Ltd.), the polyol corresponding to the second polymer, and its blending amount was set to an amount shown in Table 10.

COMPARATIVE EXAMPLE 1

A paint for forming a surface layer according to Comparative Example 1 was prepared in the same manner as in the paint for forming a surface layer according to Example 1 except that the silicone-grafted fluorine resin ("ZX-007-C") corresponding to the third polymer in the paint for forming a surface layer according to Example 1 was not used. A developing roller was produced in the same manner as in Example 1 except that this paint for forming a surface layer was used.

COMPARATIVE EXAMPLE 2

The silicone-grafted fluorine resin ("ZX-007-C") corresponding to the third polymer in the paint for forming a surface layer according to Example 1 was changed to a fluorine-containing group-hydrophilic group-lipophilic group-containing oligomer (trade name: MEGAFACE F-555; manufactured by DIC Corporation), and its blending amount was set to 5 parts by mass. A paint for forming a surface layer according to Comparative Example 2 was prepared in the same manner as in the paint for forming a surface layer according to Example 1 except the foregoing. A developing roller was produced in the same manner as in Example 1 except that this paint for forming a surface layer was used.

COMPARATIVE EXAMPLE 3

The polymer No. B-1 corresponding to the first polymer in the paint for forming a surface layer according to Example 1 was changed to an aminoethylated acrylic polymer (trade name: POLYMENT NK-380; manufactured by Nippon Shokubai Co., Ltd.), and its blending amount was set to 5 parts by mass. A paint for forming a surface layer according to Comparative Example 3 was prepared in the same manner as in the paint for forming a surface layer according to Example 1 except the foregoing. A developing roller was produced in the same manner as in Example 1 except that this paint for forming a surface layer was used. The "POLYMENT NK-380" has a structure in which a primary amino group (—$NH_2$) is grafted onto the main chain of an acrylic resin. Therefore, the "POLYMENT NK-380" does not have any one of the structures represented by the structural formulae (1) to (6).

COMPARATIVE EXAMPLES 4 AND 5

Developing rollers according to Comparative Examples 4 and 5 were produced in the same manner as in Example 12 except that the first polymer in the surface layer and its content were changed as shown in Table 11.

COMPARATIVE EXAMPLE 6

(Synthesis of Fluorine Resin D-2)

Dry methyl ethyl ketone of 150.0 parts by mass was loaded into a reaction vessel including a stirrer, a temperature gauge, a reflux tube, a dropping apparatus, and a nitrogen gas-introducing tube. In a stream of a nitrogen gas, a temperature in the vessel was increased to 87° C., and methyl ethyl ketone was heated to reflux. Next, a mixture of the materials shown in Table 7 was gradually dropped into the vessel over 1 hour. The temperature was held at 87° C., and the resultant mixture was further heated to reflux for 3 hours. Next, the temperature was reduced to 50° C., and then 100.0 parts by mass of methyl ethyl ketone was removed by distillation under reduced pressure. The residue was cooled to room temperature to provide a fluorine resin D-2 having a dimethylsiloxane-containing group, a perfluorohexyl group, and a quaternary ammonium salt group represented by the structural formula (2).

TABLE 7

| Material | Blending amount (part(s) by mass) |
|---|---|
| Monomer No. A-2 | 35.6 |
| Acrylate-modified silicone (trade name: X-22-174DX; manufactured by Shin-Etsu Chemical Co., Ltd.) | 6.4 |
| 2-(Perfluorohexyl)ethyl acrylate (trade name: CHEMINOX FAAC-6, manufactured by Unimatec Co., Ltd.) | 6.3 |
| 2-Hydroxyethyl methacrylate (manufactured by Tokyo Chemical Industry Co., Ltd.) | 1.8 |
| Polymerization initiator (trade name: KAYAESTER, manufactured by Kayaku Akzo Corporation) | 0.3 |

A paint for forming a surface layer according to this comparative example was prepared in the same manner as in the paint for forming a surface layer according to Example 1 except that the mixture used in the preparation of the paint for forming a surface layer according to Example 1 was changed to a mixture of materials shown in Table 8. A developing roller was produced in the same manner as in Example 1 except that this paint for forming a surface layer was used. The surface layer of the roller according to this comparative example is free of the first polymer. Meanwhile, its urethane resin serving as a binder resin not only has a fluorine atom and a silicon atom derived from the fluorine resin D-2 corresponding to the third polymer but also has a quaternary ammonium salt group according to the structure (2).

TABLE 8

| Material | Blending amount (parts by mass) |
|---|---|
| Polyol (trade name: Kuraray Polyol C-2090; manufactured by Kuraray Co., Ltd.) | 55.3 |
| Isocyanate group-terminated prepolymer C-2 | 55.9 |
| Carbon black (trade name: MA230; manufactured by Mitsubishi Chemical Corporation) | 20.0 |
| Urethane resin particles (trade name: Art Pearl C-400; manufactured by Negami Chemical Industrial Co., Ltd.) | 15.0 |
| Fluorine resin D-2 | 5.0 |

The respective components in the paints for forming surface layers according to Examples 1 to 27 and Comparative Examples 1 to 6, and their blending amounts are collectively shown in Table 9 to Table 11. In addition, the measured values of the "Nn", the "Nna", the "Nnb", the "Fna+Sina", and the "Fnb+Sinb" for the surface layers of the developing rollers according to Examples 1 to 27 and Comparative Examples 1 to 6 are shown in Table 12.

TABLE 9

| | | First polymer | | | Urethane resin | | | | | |
|---|---|---|---|---|---|---|---|---|---|---|
| | | | | | Polymer polyol (second/third polymer) | | Polyol (fourth polymer) | | Polyisocyanate | |
| | | Polymer No. | Structure contained | Content (part(s) by mass) | Polymer | Content (part(s) by mass) | Kind | Content (part(s) by mass) | Kind | Content (part(s) by mass) |
| Example | 1 | B-1 | (1), (7) | 5 | Silicone-grafted | 1 | "PTG-L1000" | 36.9 | C-1 | 78.6 |
| | 2 | | | | fluorine resin | 5 | | | | |
| | 3 | | | | "ZX-007-C" | 10 | | | | |
| | 4 | | | | Silicone-grafted fluorine resin D-1 | 5 | | | | |
| | 5 | | | 10 | Silicone-grafted | 5 | | | | |
| | 6 | | | 20 | fluorine resin | | | | | |
| | 7 | B-2 | | 5 | ("ZX-007-C") | | | | | |
| | 8 | B-3 | | | | | | | | |
| | 9 | B-4 | | | | | | | | |
| | 10 | B-5 | (2), (7) | 6 | | | | | | |
| | 11 | | | | Silicone-grafted fluorine resin D-1 | 5 | | | | |

TABLE 10

| | | First polymer | | | Urethane resin | | | | | |
|---|---|---|---|---|---|---|---|---|---|---|
| | | | | | Polymer polyol (second/third polymer) | | Polyol (fourth polymer) | | Polyisocyanate | |
| | | Polymer No. | Structure contained | Content (part(s) by mass) | Polymer | Content (part(s) by mass) | Kind | Content (part(s) by mass) | Kind | Content (part(s) by mass) |
| Example | 12 | B-6 | (2), (7) | 7 | Silicone-grafted | 5 | "C-2090" | 55.3 | C-2 | 55.9 |
| | 13 | B-7 | | | fluorine resin | | | | | |
| | 14 | B-8 | (1), (2), (7) | | ("ZX-007-C") | | | | | |
| | 15 | B-9 | (2), (3), (7) | | | | | | | |
| | 16 | B-10 | (3), (7) | | | | | | | |
| | 17 | B-11 | | 5 | | | | | | |
| | 18 | B-12 | (4), (7) | | | | | | | |
| | 19 | B-13 | | | | | | | | |
| | 20 | B-14 | (5), (7) | | | | | | | |
| | 21 | B-15 | | | | | | | | |
| | 22 | B-16 | (6), (7) | | | | | | | |
| | 23 | B-17 | | | | | | | | |
| | 24 | B-18 | (3) | 10 | | 3 | | | | |
| | 25 | | | 20 | | | | | | |
| | 26 | | | 10 | "LUMIFLON LF200" | 5 | | | | |
| | 27 | | | | | 1 | | | | |

TABLE 11

| | | First polymer | | | Urethane resin | | | | | |
|---|---|---|---|---|---|---|---|---|---|---|
| | | | | | Polymer polyol (second/third polymer) | | Polyol (fourth polymer) | | Polyisocyanate | |
| | | Polymer No. | Structure contained | Content (part(s) by mass) | Polymer | Content (part(s) by mass) | Kind | Content (part(s) by mass) | Kind | Content (part(s) by mass) |
| Comparative Example | 1 | B-1 | (1), (7) | 5 | — | — | PTG-L1000 | 36.9 | C-1 | 78.6 |
| | 2 | | | | Fluorine-containing group-containing oligomer ("MEGAFACE F-555") | 5 | | | | |

TABLE 11-continued

| | First polymer | | | Urethane resin | | | | | |
|---|---|---|---|---|---|---|---|---|---|
| | | | | Polymer polyol (second/third polymer) | | Polyol (fourth polymer) | | Polyisocyanate | |
| | Polymer No. | Structure contained | Content (part(s) by mass) | Polymer | Content (part(s) by mass) | Kind | Content (part(s) by mass) | Kind | Content (part(s) by mass) |
| 3 | Aminoethylated acrylic polymer ("POLYMENT NK-380") | — | 5 | Silicone-grafted fluorine resin ("ZX-007-C") | 5 | | | | |
| 4 | B-1 | (1), (7) | 0.1 | | | C-2090 | 55.3 | C-2 | 55.9 |
| 5 | B-10 | (3), (7) | 30 | | | | | | |
| 6 | — | — | — | Fluorine resin D-2 | 5 | | | | |

TABLE 12

| | Nn (atomic %) | Nna (atomic %) | Nnb (atomic %) | Fna + Sina (atomic %) | Fnb + Sinb (atomic %) |
|---|---|---|---|---|---|
| Example 1 | 6.2E−01 | 6.4E−01 | 9.9E−03 | 1.3E−03 | 1.3E+01 |
| Example 2 | 4.5E−01 | 4.6E−01 | 7.2E−03 | 1.4E−03 | 1.4E+01 |
| Example 3 | 2.2E−01 | 2.3E−01 | 3.5E−03 | 1.6E−03 | 1.5E+01 |
| Example 4 | 4.0E−01 | 4.1E−01 | 6.4E−03 | 1.3E−03 | 1.2E+01 |
| Example 5 | 8.5E−01 | 8.8E−01 | 1.4E−02 | 1.4E−03 | 1.4E+01 |
| Example 6 | 1.6E+00 | 1.6E+00 | 2.5E−02 | 1.4E−03 | 1.4E+01 |
| Example 7 | 4.9E−01 | 5.1E−01 | 7.8E−03 | 1.4E−03 | 1.4E+01 |
| Example 8 | 4.1E−01 | 4.2E−01 | 6.5E−03 | 1.4E−03 | 1.4E+01 |
| Example 9 | 2.9E−01 | 3.0E−01 | 4.6E−03 | 1.4E−03 | 1.4E+01 |
| Example 10 | 1.1E−01 | 1.1E−01 | 1.8E−03 | 1.4E−03 | 1.4E+01 |
| Example 11 | 1.1E−01 | 1.1E−01 | 1.8E−03 | 1.3E−03 | 1.3E+01 |
| Example 12 | 1.1E−01 | 1.1E−01 | 1.8E−03 | 1.4E−03 | 1.4E+01 |
| Example 13 | 1.1E−01 | 1.1E−01 | 1.8E−03 | 1.4E−03 | 1.4E+01 |
| Example 14 | 2.4E−01 | 2.5E−01 | 3.8E−03 | 1.4E−03 | 1.4E+01 |
| Example 15 | 5.6E−01 | 5.8E−01 | 9.0E−03 | 1.4E−03 | 1.4E+01 |
| Example 16 | 4.4E−01 | 4.5E−01 | 7.0E−03 | 1.4E−03 | 1.3E+01 |
| Example 17 | 3.7E−01 | 3.8E−01 | 5.9E−03 | 1.4E−03 | 1.4E+01 |
| Example 18 | 2.1E−01 | 2.2E−01 | 3.4E−03 | 1.5E−03 | 1.4E+01 |
| Example 19 | 2.1E−01 | 2.2E−01 | 3.4E−03 | 1.4E−03 | 1.4E+01 |
| Example 20 | 6.8E−01 | 7.0E−01 | 1.1E−02 | 1.4E−03 | 1.4E+01 |
| Example 21 | 2.5E−01 | 2.6E−01 | 4.0E−03 | 1.4E−03 | 1.4E+01 |
| Example 22 | 1.7E−01 | 1.8E−01 | 2.7E−03 | 1.4E−03 | 1.4E+01 |
| Example 23 | 1.1E−01 | 1.1E−01 | 1.8E−03 | 1.4E−03 | 1.4E+01 |
| Example 24 | 3.5E+00 | 3.6E+00 | 5.5E−02 | 1.4E−03 | 1.3E+01 |
| Example 25 | 6.9E+00 | 7.1E+00 | 1.1E−01 | 1.4E−03 | 1.3E+01 |
| Example 26 | 3.5E+00 | 3.6E+00 | 5.5E−02 | 1.1E−03 | 1.0E+01 |
| Example 27 | 4.3E+00 | 4.4E+00 | 6.8E−02 | 9.2E−04 | 8.9E+00 |
| Comparative Example 1 | 3.0E−01 | 2.7E−01 | 4.1E−01 | 0 | 0.0E-00 |
| Comparative Example 2 | 4.6E−01 | 4.8E−01 | 7.4E−03 | 1.2E−03 | 1.1E+01 |
| Comparative Example 3 | 5.8E−01 | 6.0E−01 | 9.3E−03 | 1.4E−03 | 1.4E+01 |
| Comparative Example 4 | 1.0E−02 | 1.2E−02 | 1.9E−04 | 1.4E−03 | 1.4E+01 |
| Comparative Example 5 | 9.5E+00 | 9.9E+00 | 1.5E−01 | 1.4E−03 | 1.3E+01 |
| Comparative Example 6 | 1.1E−01 | 1.0E−02 | 1.1E−01 | 1.2E−04 | 1.3E+01 |

<Evaluation>

<Production of Evaluation Sheet>

A sheet was produced by the following method for measuring the silica adhesion amount and triboelectric charge quantity of a surface layer. 2.0 Grams of each of the paints for forming surface layers according to the respective examples and comparative examples was applied onto a plate made of stainless steel (SUS304) with a bar coater (#120), and was heated and cured. The heat curing was performed under the same conditions as the conditions under which a coating film was cured in the production of a developing roller. Next, the heat-cured product was peeled from the stainless-steel plate to provide an evaluation sheet according to any one of Examples 1 to 27 and Comparative Examples 1 to 6. The silica adhesion amount and the triboelectric charge quantity were measured by using the resultant evaluation sheet as described below.

[Silica Adhesion Amount]

An evaluation for the silica adhesion amount under a high-temperature and high-humidity environment was performed by the following method.

First, the mass (initial mass) of each of the evaluation sheets according to the respective examples and comparative examples was measured.

Next, each evaluation sheet was placed on a flat plate made of polytetrafluoroethylene, and 3.0 g of hydrophobic silica (trade name: Aerosil (trademark) R972, manufactured by Nippon Aerosil Co., Ltd.) was placed on the surface of each evaluation sheet. Next, a flat plate made of polytetrafluoroethylene was further placed on the surface of each sheet on which the hydrophobic silica had been placed, and the flat plate made of polytetrafluoroethylene was brought into press contact with each evaluation sheet at a load of 2.94 N. Under the state, the resultant was left at rest in an environment having an air temperature of 40° C. and a relative humidity of 95% RH for 10 minutes. Next, each evaluation sheet was released from the press-contact state, and the surface of each evaluation sheet on which the hydrophobic silica had been placed was subjected to air blowing with an air gun (trade name: AIR DUSTER DS-3; Meiji Air Compressor MFG. Co., Ltd., nozzle diameter=2.2 mm) under the following conditions.

Air pressure: 0.75 MPa

Wind speed at measurement portion: 25 m/sec

Distance from nozzle to evaluation sheet: 30 cm

Air blowing time: 5 sec

After that, the mass of each evaluation sheet was measured again. The amount (mg) of the hydrophobic silica adhering to each evaluation sheet was obtained by calculating a difference between the initial mass and mass after the air blowing of each evaluation sheet.

[Triboelectric Charge Quantity]

The measurement of the triboelectric charge quantity of each evaluation sheet was performed in accordance with the following procedure after each evaluation sheet had been left at rest in a high-temperature and high-humidity environment having an air temperature of 40° C. and a relative humidity of 95% RH for 6 hours. A cascade-type surface charge quantity-measuring apparatus TS-100AT (trade name, manufactured by Kyocera Chemical Corporation) was used in the measurement of the triboelectric charge quantity of each evaluation sheet. A standard carrier N-01 (the Imaging Society of Japan) was used as a carrier. The falling time of the carrier was set to 10 seconds. The total charge quantity of the carrier that had fallen into a receiving dish placed on an insulating plate was measured with a potentiometer connected in parallel with a capacitor, and was defined as a charge quantity Q (μC). Further, the mass (g) of the carrier that had fallen into the receiving dish was measured, and a charge quantity Q/M (μC/g) per unit mass determined from those values was defined as the triboelectric charge quantity of each evaluation sheet.

<Evaluation as Developing Roller>

A fogging image evaluation, and the measurement of the triboelectric charge quantity of toner and the triboelectric charge quantity distribution of the toner were performed for each of the developing rollers according to the respective examples and comparative examples as described below.

[Fogging Image Evaluation]

The fogging image evaluation was performed by loading each of the developing rollers according to the respective examples and comparative examples into a magenta toner cartridge for a laser printer having a construction illustrated in FIG. 3 (trade name: HP Color Laserjet Enterprise CP4515dn, manufactured by HP Inc.). The magenta toner cartridge into which each developing roller had been loaded was loaded into the laser printer, and was placed in a high-temperature and high-humidity environment having an air temperature of 32° C. and a relative humidity of 85% RH, followed by being left to stand for 6 hours.

Next, such an image that an alphabetical letter "E" having a size of 4 points was printed at a coverage of 1% with respect to the area of A4 size paper (hereinafter sometimes referred to as "E-letter image") was continuously output on a predetermined number of sheets of copy paper. After that, a white solid image was output on new copy paper, and the printer was stopped during the output of the white solid image. At this time, toner adhering onto a photosensitive member was peeled off with a tape (trade name: CT18; manufactured by Nichiban Co., Ltd.), and a reflectance was measured with a reflection densitometer (trade name: TC-6DS/A, manufactured by Tokyo Denshoku Co., Ltd.). The reduction amount (%) of the reflectance with reference to the reflectance of the tape was measured, and the measured value was defined as a fogging value.

A fogging value measured after an image having a print percentage of 0.5% had been output on 100 sheets was defined as an initial fogging value, and a fogging value measured after the image having a print percentage of 0.5% had been output on 30,000 sheets was defined as a fogging value after endurance. When a fogging value becomes 5% or more, the consumption of the toner increases, and hence a reduction in image density or such an image failure that the toner is developed in a non-imaging region occurs at the time of printing on many sheets. As the fogging value becomes lower, the consumption of the toner is suppressed and hence a stable image can be output over a long time period.

[Triboelectric Charge Quantity of Toner]

A triboelectric charge quantity was measured for evaluating the triboelectric charge imparting ability of a developing roller to the toner.

At the time of the fogging image evaluation, the toner carried by a portion having the narrower range out of the portions of the developing roller sandwiched between a toner-regulating blade and the position at which the roller abutted on the photosensitive member was sucked and collected with a metal cylindrical tube and a cylindrical filter. At that time, the quantity of charge stored in a capacitor through the metal cylindrical tube and the mass of the sucked toner were measured. The measurement of the charge quantity was performed with a measuring machine (trade name: 8252) manufactured by ADC Corporation. Then, a charge quantity per unit mass (μC/g) was calculated from those values. When negatively chargeable toner is used, the sign of its charge quantity per unit mass is negative, and it can be said that as the absolute value of the charge quantity increases, the triboelectric charge imparting ability of the developing roller becomes higher. The value obtained in the measurement was defined as a triboelectric charge quantity. A value measured after the output of the image having a print percentage of 0.5% on 100 sheets was defined as the initial triboelectric charge quantity of the toner, and a value measured after the output of the image having a print percentage of 0.5% on 30,000 sheets was defined as the triboelectric charge quantity of the toner after endurance.

[Triboelectric Charge Quantity Distribution of Toner]

A triboelectric charge quantity distribution was measured for evaluating the spread of the triboelectric charge quantity of the toner.

The triboelectric charge quantity distribution was measured with E-Spart Analyzer Model EST-III (manufactured by Hosokawa Micron Corporation). The triboelectric charge quantity distribution was measured in the same manner as in the measurement of the triboelectric charge quantity of the toner except the foregoing. The number of particles to be measured was set to about 3,000. A standard deviation was calculated from the resultant triboelectric charge quantity distribution. The standard deviation of values measured after the output of the image having a print percentage of 0.5% on 100 sheets was defined as the initial triboelectric charge quantity distribution of the toner, and the standard deviation of values measured after the output of the image having a print percentage of 0.5% on 30,000 sheets was defined as the triboelectric charge quantity distribution of the toner after endurance.

The evaluation results are shown in Table 13.

TABLE 13

| | | Sheet | | Developing roller | | | | | |
|---|---|---|---|---|---|---|---|---|---|
| | | Triboelectric charge quantity (μC/g) | Silica adhesion amount (mg) | Fogging (%) | | Triboelectric charge quantity (μC/g) | | Charge quantity distribution | |
| | | | | Initial | After endurance | Initial | After endurance | Initial | After endurance |
| Example | 1 | −4.1 | 0.13 | 0.9 | 1.1 | −42 | −39 | 3.3 | 2.9 |
| | 2 | −4.0 | 0.14 | 1.1 | 1.2 | −40 | −37 | 3.2 | 3.0 |
| | 3 | −3.8 | 0.14 | 1.2 | 1.4 | −39 | −37 | 3.3 | 3.1 |
| | 4 | −4.1 | 0.11 | 0.8 | 0.9 | −41 | −40 | 3.0 | 2.8 |
| | 5 | −4.3 | 0.14 | 0.9 | 1.1 | −42 | −39 | 3.4 | 3.3 |
| | 6 | −4.5 | 0.13 | 0.8 | 1.1 | −43 | −39 | 3.3 | 3.1 |
| | 7 | −4.0 | 0.14 | 1.1 | 1.3 | −39 | −37 | 3.4 | 3.2 |
| | 8 | −3.9 | 0.13 | 1.2 | 1.4 | −39 | −36 | 3.5 | 3.2 |
| | 9 | −3.8 | 0.14 | 1.2 | 1.4 | −39 | −37 | 3.4 | 3.1 |
| | 10 | −3.8 | 0.14 | 1.1 | 1.4 | −38 | −36 | 3.5 | 3.2 |
| | 11 | −3.9 | 0.11 | 0.9 | 1.0 | −39 | −38 | 3.1 | 2.8 |
| | 12 | −3.8 | 0.13 | 1.1 | 1.3 | −39 | −36 | 3.4 | 3.3 |
| | 13 | −3.7 | 0.14 | 1.2 | 1.4 | −38 | −36 | 3.5 | 3.4 |
| | 14 | −3.8 | 0.14 | 1.0 | 1.2 | −38 | −35 | 3.3 | 3.2 |
| | 15 | −3.8 | 0.14 | 1.1 | 1.2 | −39 | −36 | 3.5 | 3.3 |
| | 16 | −3.7 | 0.15 | 1.2 | 1.3 | −37 | −35 | 4.0 | 3.9 |
| | 17 | −3.6 | 0.14 | 1.2 | 1.4 | −37 | −35 | 3.8 | 3.7 |
| | 18 | −3.7 | 0.14 | 1.1 | 1.3 | −38 | −35 | 3.9 | 3.8 |
| | 19 | −3.6 | 0.13 | 1.3 | 1.5 | −37 | −35 | 4.0 | 3.9 |
| | 20 | −3.7 | 0.15 | 1.1 | 1.3 | −38 | −36 | 4.1 | 4.0 |
| | 21 | −3.7 | 0.14 | 1.0 | 1.3 | −37 | −35 | 4.0 | 3.8 |
| | 22 | −3.8 | 0.13 | 1.0 | 1.2 | −39 | −36 | 3.8 | 3.7 |
| | 23 | −4.0 | 0.14 | 0.9 | 1.2 | −41 | −37 | 3.9 | 3.7 |
| | 24 | −3.4 | 0.15 | 1.0 | 1.4 | −34 | −31 | 4.2 | 4.0 |
| | 25 | −3.2 | 0.15 | 1.1 | 1.3 | −34 | −30 | 4.4 | 4.3 |
| | 26 | −3.2 | 0.21 | 1.1 | 1.9 | −33 | −29 | 4.1 | 4.0 |
| | 27 | −3.3 | 0.30 | 1.1 | 2.3 | −33 | −27 | 4.2 | 4.0 |
| Comparative Example | 1 | −4.1 | 1.41 | 0.9 | 5.1 | −41 | −22 | 5.5 | 5.4 |
| | 2 | −4.0 | 0.23 | 1.0 | 5.0 | −40 | −20 | 6.2 | 6.4 |
| | 3 | −2.1 | 0.15 | 4.6 | 4.8 | −22 | −20 | 5.2 | 5.1 |
| | 4 | −2.4 | 0.14 | 4.8 | 5.0 | −24 | −22 | 5.1 | 5.0 |
| | 5 | −5.1 | 0.15 | 4.9 | 5.1 | −51 | −49 | 5.4 | 5.1 |
| | 6 | −4.1 | 0.42 | 4.3 | 4.8 | −42 | −35 | 7.1 | 7.5 |

As shown in Table 13, the sheets according to the respective examples had small silica adhesion amounts and their triboelectric charge quantities showed satisfactory values. Even when each of the sheets was evaluated as a developing roller, both the initial triboelectric charge quantity of the toner and the triboelectric charge quantity thereof after the endurance showed high values, both the initial charge quantity distribution thereof and the charge quantity distribution thereof after the endurance showed low values, and the fogging values were satisfactory. Of those, the developing rollers according to Examples 1 to 26 had low silica adhesion amounts and showed fogging values after the endurance of less than 2% because the sum (Fnb+Sinb) of the ratio of the number of fluorine atoms in a region from the outer surface of the surface layer of each of the rollers to a depth of 10 nm and the ratio of the number of silicon atoms in the region was 10.0 atomic % or more.

Further, the values for the silica adhesion amounts of the developing rollers according to Examples 1 to 25 were as low as 0.15 mg or less because the rollers each contained, as the urethane resin according to the present invention, a silicone-grafted fluorine resin having a structure derived from the third polymer containing a fluorine atom and a silicon atom.

In addition, in each of the rollers, a difference between the values for the initial triboelectric charge quantity of the toner and the triboelectric charge quantity thereof after the endurance is small. In each of Examples 1 to 23 each containing the first polymer further having the structure (7) in addition to the structures (1) to (6), the value for the triboelectric charge quantity of the sheet is as high as −3.6 μC/g or less, and the value for the initial triboelectric charge quantity of the toner is as high as −37 μC/g or less. In particular, in each of Examples 1 to 15, both the values for the initial charge quantity distribution and the charge quantity distribution after the endurance are as small as 3.5 or less because each of the examples contains the first polymer having the structure (1) or (2).

Meanwhile, in each of the developing rollers according to Comparative Example 1 and Comparative Example 2, the initial triboelectric charge quantity showed a high value, but the triboelectric charge quantity after the endurance reduced and the fogging value after the endurance was as high as about 5%. This is probably because of the following reason: the developing roller according to Comparative Example 1 was free of the urethane resin according to the present invention, and hence an external additive of the toner adhered to its surface and the charge-imparting effect of the polymer No. B-1 was blocked by the printing on many sheets.

The developing roller according to Comparative Example 2 contains a fluorine resin in its surface layer, but the fluorine resin is not bonded to the urethane resin. Accordingly, it is assumed that the surface layer was worn by the printing on many sheets to be reduced in suppressing effect on the adhesion of the external additive of the toner, and hence the same state as that of Comparative Example 1 was established to cause fogging.

The developing roller according to Comparative Example 3 was free of the first polymer having at least one of the structures (1) to (6), and hence the values for the triboelectric charge quantities were low and fogging occurred. In Comparative Example 4 in which the value for the Nn was as low as 0.01 atomic %, the amount of the polymer present near the surface layer was small and hence a sufficient triboelectric charge quantity-imparting effect could not be exhibited. Accordingly, the values for the triboelectric charge quantities were low and fogging occurred.

Meanwhile, in Comparative Example 5 in which the value for the Nn was as high as 9.54 atomic %, the initial triboelectric charge quantity was −51 μC/g, and hence the toner was excessively charged to cause fogging.

The surface layer of the developing roller according to Comparative Example 6 contains the urethane resin having the structure derived from the fluorine resin D-2 having the quaternary ammonium salt group according to the structure (2), a perfluorohexyl group, and a siloxane-containing group, and is free of the first polymer. Accordingly, the Nna is smaller than the Nnb, i.e., the expression (2) is not satisfied. As the Nnb increases, a hydrophobic group, such as a perfluorohexyl group, and a hydrophilic group, such as the structure (2), are present near the surface of the surface layer under such a state as to be dispersed. Accordingly, hydrophobic groups or hydrophilic groups are liable to form a domain. When the structure (2) serving as a hydrophilic group forms a domain, a triboelectric charge imparting ability is improved only in a portion where the domain is present. Probably as a result of the foregoing, a difference occurred between the triboelectric charge quantities of the toner in contact with the domain and the toner out of contact therewith to widen the triboelectric charge quantity distributions.

<Production of Charging Roller>

EXAMPLE 28

Materials shown in Table 14 were mixed with a pressure kneader to provide an A-kneaded rubber composition 1.

TABLE 14

| | |
|---|---|
| NBR rubber material (trade name: Nipol (trademark) DN219, manufactured by Zeon Corporation | 100 parts by mass |
| Carbon black (trade name: TOKA BLACK #7360SB, manufactured by Tokai Carbon Co., Ltd. | 40 parts by mass |
| Calcium carbonate (trade name: NANOX#30, manufactured by Maruo Calcium Co., Ltd.) | 20 parts by mass |
| Stearic acid (trade name: Stearic Acid S, manufactured by Kao Corporation) | 1 part by mass |
| Zinc oxide | 5 parts by mass |

Further, the resultant A-kneaded rubber composition 1 and materials shown in Table 15 were mixed with an open roll to provide an unvulcanized rubber composition 1.

TABLE 15

| | |
|---|---|
| A-kneaded rubber composition 1 | 77 parts by mass |
| Sulfur (trade name: Sulfax 200S, manufactured by Tsurumi Chemical Industry Co., Ltd.) | 1.2 parts by mass |
| Tetrabenzylthiuram disulfide (trade name: SANCELER TBZTD, manufactured by Sanshin Chemical Industry Co., Ltd.) | 4.5 parts by mass |

(Preparation of Substrate)

A product obtained by applying a primer (trade name: DY35-051, manufactured by Dow Corning Toray Co., Ltd.) to a mandrel made of stainless steel (SUS304) having a diameter of 6 mm and baking the primer in an oven heated to a temperature of 180° C. for 20 minutes was prepared as a substrate.

(Formation of Elastic Layer)

An unvulcanized rubber elastic layer formed of the unvulcanized rubber composition 1 was formed on the substrate using a crosshead extruder, and the curing reaction of the unvulcanized rubber elastic layer was completed by heating the layer in an oven heated to a temperature of 160° C. for 70 minutes. After that, the surface of the elastic layer was polished with a rotary grindstone. Thus, an elastic roller in which a diameter at its central portion was 8.5 mm and a diameter at each of positions distant from the central portion toward both end portions by 90 mm each was 8.4 mm was obtained.

(Preparation of Paint for Forming Surface Layer)

Methyl ethyl ketone was added to a mixture of materials shown in Table 16 so that a total solid content ratio became 30 mass %, followed by mixing with a sand mill. Next, methyl ethyl ketone was further added to adjust the viscosity of the mixture to from 10 cps to 12 cps. Thus, a paint for forming a surface layer according to Example 28 was prepared.

TABLE 16

| Material | Blending amount (part(s) by mass) |
|---|---|
| Polyol (trade name: PTG-L1000; manufactured by Hodogaya Chemical Co., Ltd,) | 31.7 |
| Isocyanate group-terminated prepolymer C-1 | 68.3 |
| Carbon black (trade name: MA230; manufactured by Mitsubishi Chemical Corporation) | 15.0 |
| Polymer No. B-1 | 5.0 |
| Silicone-grafted fluorine resin (trade name: ZX-007-C; manufactured by T&K Toka Co., Ltd.) | 1.0 |

(Production of Charging Roller)

A coating film of the paint for forming a surface layer according to Example 28 was formed on the surface of the elastic layer of the elastic roller produced in advance by immersing the elastic roller in the paint, and was dried. Further, the resultant was subjected to a heat treatment at a temperature of 150° C. for 1 hour. Thus, a charging roller according to Example 28 having a surface layer having a thickness of about 15 μm formed on the outer periphery of the elastic layer was obtained.

EXAMPLES 29 TO 32

Paints for forming surface layers according to Examples 29 to 32 were prepared in the same manner as in Example 28 except that the kinds and blending amounts of the first polymer and the polymer polyol in the paint for forming a surface layer according to Example 28 were changed as shown in Table 18. Charging rollers according to the respective examples were produced in the same manner as in Example 28 except that the paints for forming surface layers according to the respective examples were used.

COMPARATIVE EXAMPLE 7

The silicone-grafted fluorine resin ("ZX-007-C") corresponding to the third polymer in the paint for forming a surface layer according to Example 28 was changed to a fluorine-containing group-hydrophilic group-lipophilic group-containing oligomer (trade name: MEGAFACE F-555; manufactured by DIC Corporation), and its blending amount was set to 5 parts by mass. A paint for forming a surface layer according to Comparative Example 7 was prepared in the same manner as in the paint for forming a surface layer according to Example 28 except the foregoing. A charging roller was produced in the same manner as in Example 28 except that this paint for forming a surface layer was used.

COMPARATIVE EXAMPLE 8

The polymer No. B-1 corresponding to the first polymer in the paint for forming a surface layer according to Example 28 was changed to an aminoethylated acrylic polymer (trade name: POLYMENT NK-380; manufactured by Nippon Shokubai Co., Ltd.), and its blending amount was set to 5 parts by mass. A paint for forming a surface layer according to Comparative Example 8 was prepared in the same manner as in the paint for forming a surface layer according to Example 28 except the foregoing. A charging roller was produced in the same manner as in Example 28 except that this paint for forming a surface layer was used.

COMPARATIVE EXAMPLE 9

A paint for forming a surface layer according to Comparative Example 9 was prepared in the same manner as in the paint for forming a surface layer according to Example 28 except that the blending amount of the polymer No. B-1 corresponding to the first polymer in the paint for forming a surface layer according to Example 28 was changed to 0.1 part by mass. A charging roller was produced in the same manner as in Example 28 except that this paint for forming a surface layer was used.

COMPARATIVE EXAMPLE 10

A paint for forming a surface layer according to this comparative example was prepared in the same manner as in the paint for forming a surface layer according to Example 28 except that the mixture used in the preparation of the paint for forming a surface layer according to Example 28 was changed to a mixture of materials shown in Table 17. A charging roller was produced in the same manner as in Example 28 except that this paint for forming a surface layer was used. The surface layer of the roller according to this comparative example is free of the first polymer. Meanwhile, its urethane resin serving as a binder resin not only has a fluorine atom and a silicon atom derived from the fluorine resin D-2 corresponding to the third polymer but also has a quaternary ammonium salt group according to the structural formula (2).

TABLE 17

| Material | Blending amount (parts by mass) |
|---|---|
| Polyol (trade name: PTG-L1000; manufactured by Hodogaya Chemical Co., Ltd.) | 31.7 |
| Isocyanate group-terminated prepolymer C-1 | 68.3 |
| Carbon black (trade name: MA230; manufactured by Mitsubishi Chemical Corporation) | 15.0 |
| Fluorine resin D-2 | 5.0 |

The respective components in the paints for forming surface layers according to Examples 28 to 32 and Comparative Examples 7 to 10, and their blending amounts are collectively shown in Table 18. In addition, the measured values of the "Nn", the "Nna", the "Nnb", the "Fna+Sina", and the "Fnb+Sinb" for the surface layers of the charging rollers according to Examples 28 to 32 and Comparative Examples 7 to 10 are shown in Table 19.

TABLE 18

| | First polymer | | | Urethane resin: Polymer polyol (second/third polymer) | | Urethane resin: Polyol (fourth polymer) | | Urethane resin: Polyisocyanate | |
|---|---|---|---|---|---|---|---|---|---|
| | Polymer No. | Structure contained | Content (part(s) by mass) | Polymer | Content (part(s) by mass) | Kind | Content (part(s) by mass) | Kind | Content (part(s) by mass) |
| Example 28 | B-1 | (1), (7) | 5 | Silicone-grafted fluorine resin ("ZX-007-C") | 1 | "PTG-L1000" | 31.7 | C-1 | 68.3 |
| Example 29 | | | | Silicone-grafted fluorine resin D-1 | 5 | | | | |
| Example 30 | B-5 | (2), (7) | 6 | Silicone-grafted fluorine resin ("ZX-007-C") | | | | | |
| Example 31 | B-8 | (1), (2), (7) | 7 | | | | | | |
| Example 32 | B-10 | (3), (7) | | | | | | | |
| Comparative Example 7 | B-1 | (1), (7) | 5 | Fluorine-containing group-containing oligomer "MEGAFACE F-555" | 5 | "PTG-L1000" | 31.7 | C-1 | 68.3 |

TABLE 18-continued

| | First polymer | | | Urethane resin: Polymer polyol (second/third polymer) | | Urethane resin: Polyol (fourth polymer) | | Urethane resin: Polyisocyanate | |
|---|---|---|---|---|---|---|---|---|---|
| | Polymer No. | Structure contained | Content (part(s) by mass) | Polymer | Content (part(s) by mass) | Kind | Content (part(s) by mass) | Kind | Content (part(s) by mass) |
| Comparative Example 8 | Aminoethylated acrylic polymer "POLYMENT NK-380" | — | 5 | Silicone-grafted fluorine resin ("ZX-007-C") | 5 | | | | |
| Comparative Example 9 | B-1 | (1), (7) | 0.1 | | | | | | |
| Comparative Example 10 | — | — | — | Fluorine resin D-2 | 5 | | | | |

TABLE 19

| | Nn (atomic %) | Nna (atomic %) | Nnb (atomic %) | Fna + Sina (atomic %) | Fnb + Sinb (atomic %) |
|---|---|---|---|---|---|
| Example 28 | 6.5E−01 | 6.7E−01 | 9.3E−03 | 1.4E−03 | 1.3E+01 |
| Example 29 | 4.0E−01 | 4.1E−01 | 6.4E−03 | 1.28E−03 | 1.2E+01 |
| Example 30 | 1.2E−01 | 1.2E−01 | 1.8E−03 | 1.56E−03 | 1.4E+01 |
| Example 31 | 2.4E−01 | 2.5E−01 | 3.8E−03 | 1.41E−03 | 1.4E+01 |
| Example 32 | 4.5E−01 | 4.6E−01 | 7.0E−03 | 1.42E−03 | 1.3E+01 |
| Comparative Example 7 | 4.3E−01 | 4.4E−01 | 6.8E−03 | 1.12E−03 | 1.1E+01 |
| Comparative Example 8 | 5.9E−01 | 6.1E−01 | 9.0E−03 | 1.43E−03 | 1.3E+01 |
| Comparative Example 9 | 1.0E−02 | 1.1E−02 | 1.9E−04 | 1.32E−03 | 1.4E+01 |
| Comparative Example 10 | 1.2E−01 | 2.2E−02 | 1.2E−01 | 2.61E−04 | 1.3E+01 |

<Evaluation as Charging Roller>

[Horizontal Streak Image Evaluation in High-Temperature and High-Humidity Environment]

When the surface resistance of a charging roller is partially increased by the adhesion of toner or the like to the surface of the charging roller, fine streak-like density unevenness may occur in a halftone image. The resultant image is referred to as "horizontal streak image." The horizontal streak image tends to worsen as the amount of dirt on the surface of the charging roller increases, and tends to be conspicuous in association with long-term utilization of the roller. In view of the foregoing, each of the charging rollers according to Examples 28 to 32 and Comparative Examples 7 to 10 was incorporated as a charging roller, and the following evaluation was performed.

Each of the charging rollers according to Examples 28 to 32 and Comparative Examples 7 to 10 was loaded into a cyan toner cartridge for an electrophotographic laser printer (trade name: HP Color Laserjet Enterprise CP4515dn, manufactured by HP Inc.). The cyan toner cartridge into which the charging roller had been loaded was loaded into the laser printer, and was placed in a high-temperature and high-humidity environment having an air temperature of 32° C. and a relative humidity of 95% RH, followed by being left to stand for 2 hours. Next, an endurance test in which an E-letter image having a coverage of 0.5% with respect to the area of A4 size paper was continuously output was performed. In addition, after the image had been output on 100 sheets or 30,000 sheets, a halftone image (such an image that horizontal lines each having a width of 1 dot were drawn in the direction vertical to the rotation direction of the photosensitive member at an interval of 2 dots) was output for an image check. The resultant image was visually observed and a horizontal streak was evaluated by the following criteria. A horizontal streak after the output on 100 sheets was defined as an initial horizontal streak, and a horizontal streak after the output on 30,000 sheets was defined as a horizontal streak after endurance. The results are shown in Table 20.

Rank A: The level at which no horizontal streak occurs.

Rank B: The level at which a horizontal streak slightly occurs only in an end portion of an image.

Rank C: The level at which a horizontal streak occurs in a substantially half region of an image and is conspicuous.

TABLE 20

| | Horizontal streak evaluation rank: Initial | Horizontal streak evaluation rank: After endurance |
|---|---|---|
| Example 28 | A | A |
| Example 29 | A | A |
| Example 30 | A | A |
| Example 31 | A | A |
| Example 32 | A | A |
| Comparative Example 7 | A | C |
| Comparative Example 8 | C | C |
| Comparative Example 9 | C | C |
| Comparative Example 10 | B | C |

As shown in Table 20, the charging rollers according to the respective examples provided satisfactory results because no horizontal streaks occurred at the initial stage and after the endurance in each of the rollers.

Meanwhile, in the charging roller according to Comparative Example 7 containing the fluorine resin not bonded to the urethane resin, the fluorine resin was peeled by the printing on many sheets, and hence the suppressing effect of the roller on the adhesion of the toner disappeared and the horizontal streak occurred in the evaluation after the endurance.

In addition, in the charging roller according to Comparative Example 8, both the initial horizontal streak and the horizontal streak after the endurance occurred. This is probably because a sufficient triboelectric charge quantity could not be imparted to the toner and hence the charge quantity of the toner reduced. When the charge quantity of the toner is large, a repulsive force acts between the toner and the charging roller having negative charge. However, when the charge quantity of the toner is small, the following tendency is observed: the repulsive force weakens and hence the toner adheres to the surface of the charging roller. Accordingly, it is assumed that the amount of the toner adhering to the surface of the charging roller increased, and hence the horizontal streaks occurred.

The charging roller according to Comparative Example 8 is free of the first polymer having at least one of the structures (1) to (6). Accordingly, it is assumed that a triboelectric charge-imparting effect was not obtained, and hence the charge quantity of the toner reduced and the horizontal streaks occurred.

In the charging roller according to Comparative Example 9 in which the value for the Nn was as low as 0.01 atomic %, the horizontal streak occurred from the initial stage because the amount of the first polymer present near the surface layer was small and hence a sufficient triboelectric charge quantity-imparting effect could not be exhibited.

In the charging roller according to Comparative Example 10 containing the fluorine resin D-2 having the structure (2), a perfluorohexyl group, and a siloxane-containing group, the initial horizontal streak slightly occurred and the horizontal streak was conspicuous after the endurance.

In the charging roller according to Comparative Example 10, as in Comparative Example 6, the Nna is smaller than the Nnb, and hence a hydrophobic group, such as a perfluorohexyl group, and a hydrophilic group, such as the structure (2), are present under such a state as to be dispersed. Accordingly, hydrophobic groups or hydrophilic groups are liable to form a domain. When the structure (2) serving as a hydrophilic group forms a domain, a triboelectric charge imparting ability is improved only in a portion where the domain is present. As a result, a difference occurs between the triboelectric charge quantities of the toner in contact with the domain and the toner out of contact therewith to widen the triboelectric charge quantity distribution of the toner. As the charge quantity distribution enlarges, toner having a low charge quantity also occurs. Accordingly, it is assumed that the toner adhered and hence the initial horizontal streak slightly occurred. Meanwhile, in the portion where the structure (2) had formed the domain, the horizontal streak was caused by the endurance because a suppressing effect on the adhesion of the toner was absent.

<Production of Developing Blade>

EXAMPLE 33

(Preparation of Paint for Forming Blade Elastic Layer)

A paint for forming a blade elastic layer was prepared as a material for an elastic layer of a developing blade by stirring and mixing 25.8 parts by mass of an amine-based polyol (trade name: EXCENOL 500ED, manufactured by Asahi Glass Co., Ltd.), 113.6 parts by mass of a polyisocyanate (trade name: CORONATE L, manufactured by Tosoh Corporation), 1.4 parts by mass of an ionic electroconductive agent (trade name: PEL-20A, manufactured by Japan Carlit Co., Ltd.), 10.0 parts by mass of silica (trade name: AEROSIL 200, manufactured by Nippon Aerosil Co., Ltd.), and 150.8 parts by mass of methyl ethyl ketone.

(Production of Developing Blade)

A plate of stainless steel (SUS304, manufactured by Nisshin Steel Co., Ltd.) having a thickness of 0.08 mm was subjected to press cutting into dimensions measuring 215 mm long by 23 mm wide to prepare a sheet made of the stainless steel as a substrate. Next, as illustrated in FIG. 2B, a coating film of the paint for forming a blade elastic layer was formed by immersing the substrate in the paint to a depth of 1.5 mm so that its longitudinal direction was parallel to the paint, and the coating film was dried. Further, the resultant was subjected to a heat treatment at a temperature of 120° C. for 30 minutes. Thus, an elastic layer having a thickness of 10 μm was formed on the surface of a longitudinal-side end portion of the substrate.

After that, as in the elastic layer, a coating film was formed by immersing the portion of the substrate where the elastic layer had been formed in the paint for forming a surface layer according to Example 28, and was then dried at room temperature for 10 minutes. Further, the resultant was heated and cured in an environment having a temperature of 80° C. and a relative humidity of 90% RH for 2 hours. Thus, a developing blade according to Example 33 was produced. Its surface layer had a thickness of 20 μm.

EXAMPLES 34 TO 37

Paints for forming surface layers according to Examples 34 to 37 were prepared in the same manner as in Example 33 except that the kinds and blending amounts of the first polymer and the polymer polyol in the paint for forming a surface layer according to Example 33 were changed as shown in Table 21. Developing blades according to the respective examples were produced in the same manner as in Example 33 except that the paints for forming surface layers according to the respective examples were used.

COMPARATIVE EXAMPLES 11 TO 14

Developing blades were produced in the same manner as in Example 33 except that the paints for forming surface layers according to Comparative Examples 7 to 10 were used.

The respective components in the paints for forming surface layers according to Examples 33 to 37 and Comparative Examples 11 to 14, and their blending amounts are collectively shown in Table 21. In addition, the measured values of the "Nn", the "Nna", the "Nnb", the "Fna+Sina", and the "Fnb+Sinb" for the surface layers of the developing blades according to Examples 33 to 37 and Comparative Examples 11 to 14 are shown in Table 22.

TABLE 21

| | First polymer | | | Urethane resin | | | | | |
|---|---|---|---|---|---|---|---|---|---|
| | | | | Polymer polyol (second/third polymer) | | Polyol (fourth polymer) | | Polyisocyanate | |
| | Polymer No. | Structure contained | Content (part(s) by mass) | Polymer | Content (part(s) by mass) | Kind | Content (part(s) by mass) | Kind | Content (part(s) by mass) |
| Example 33 | B-1 | (1), (7) | 5 | Silicone-grafted fluorine resin ("ZX-007-C") | 1 | "PTG-L1000" | 31.7 | C-1 | 68.3 |

TABLE 21-continued

| | First polymer | | | Urethane resin | | | | | |
|---|---|---|---|---|---|---|---|---|---|
| | | | | Polymer polyol (second/third polymer) | | Polyol (fourth polymer) | | Polyisocyanate | |
| | Polymer No. | Structure contained | Content (part(s) by mass) | Polymer | Content (part(s) by mass) | Kind | Content (part(s) by mass) | Kind | Content (part(s) by mass) |
| Example 34 | | | | Silicone-grafted fluorine resin D-1 | 5 | | | | |
| Example 35 | B-5 | (2), (7) | 6 | Silicone-grafted fluorine resin ("ZX-007-C") | | | | | |
| Example 36 | B-8 | (1), (2), (7) | 7 | | | | | | |
| Example 37 | B-10 | (3), (7) | | | | | | | |
| Comparative Example 11 | B-1 | (1), (7) | 5 | Fluorine-containing group-containing oligomer ("MEGAFACE F-555") | 5 | "PTG-L1000" | 31.7 | C-1 | 68.3 |
| Comparative Example 12 | Aminoethylated acrylic polymer ("POLYMENT NK-380") | — | 5 | Silicone-grafted fluorine resin ("ZX-007-C") | 5 | | | | |
| Comparative Example 13 | B-1 | (1), (7) | 0.1 | | | | | | |
| Comparative Example 14 | — | — | — | Fluorine resin D-2 | 5 | | | | |

TABLE 22

| | Nn (atomic %) | Nna (atomic %) | Nnb (atomic %) | Fna + Sina (atomic %) | Fnb + Sinb (atomic %) |
|---|---|---|---|---|---|
| Example 33 | 6.3E−01 | 6.5E−01 | 9.1E−03 | 1.4E−03 | 1.3E+01 |
| Example 34 | 4.1E−01 | 4.2E−01 | 6.2E−03 | 1.3E−03 | 1.2E+01 |
| Example 35 | 1.3E−01 | 1.3E−01 | 1.8E−03 | 1.7E−03 | 1.4E+01 |
| Example 36 | 2.2E−01 | 2.3E−01 | 3.8E−03 | 1.3E−03 | 1.3E+01 |
| Example 37 | 4.7E−01 | 4.9E−01 | 7.1E−03 | 1.5E−03 | 1.4E+01 |
| Comparative Example 11 | 4.2E−01 | 4.3E−01 | 7.1E−03 | 1.1E−03 | 1.1E+01 |
| Comparative Example 12 | 6.1E−01 | 6.3E−01 | 9.4E−03 | 1.4E−04 | 1.4E+01 |
| Comparative Example 13 | 1.0E−02 | 1.0E−02 | 1.9E−04 | 1.2E−03 | 1.3E+01 |
| Comparative Example 14 | 1.1E−01 | 2.2E−02 | 1.2E−01 | 2.6E−04 | 1.2E+01 |

TABLE 23

| | Fogging (%) | | Charge quantity distribution | |
|---|---|---|---|---|
| | Initial | After endurance | Initial | After endurance |
| Example 33 | 0.9 | 1.2 | 3.2 | 3.0 |
| Example 34 | 0.7 | 0.9 | 2.9 | 2.6 |
| Example 35 | 1.1 | 1.5 | 3.4 | 3.1 |
| Example 36 | 1.2 | 1.4 | 3.4 | 3.3 |
| Example 37 | 1.3 | 1.5 | 4.1 | 4.2 |
| Comparative Example 11 | 1.1 | 5.3 | 6.2 | 6.4 |
| Comparative Example 12 | 4.9 | 5.2 | 5.3 | 5.1 |
| Comparative Example 13 | 4.9 | 5.2 | 5.1 | 5.0 |
| Comparative Example 14 | 4.9 | 5.0 | 7.3 | 7.4 |

The developing blades according to Examples 33 to 37 and Comparative Examples 11 to 14 were subjected to the following evaluations.

<Evaluation as Developing Blade>

[Fogging Image Evaluation]

The developing blade of a magenta toner cartridge for a laser printer (trade name: HP Color Laserjet Enterprise CP4515dn, manufactured by HP Inc.) was changed to any one of the developing blades according to Examples 33 to 37 and Comparative Examples 11 to 14. A fogging image evaluation was performed in the same manner as in "Fogging Image Evaluation" in Example 1 except that any such magenta toner cartridge was used.

[Triboelectric Charge Quantity Distribution of Toner]

The triboelectric charge quantity distribution of toner was measured in the same manner as in the measuring method for "Triboelectric Charge Quantity Distribution of Toner" in Example 1 except that the magenta toner cartridge used in the fogging image evaluation was used.

The evaluation results are shown in Table 23.

As shown in Table 23, the developing blades according to Examples 33 to 37 each having the surface layer according to the present invention showed satisfactory results because both the initial fogging value and the fogging value after the endurance were 2% or less in each of the blades. Further, the charge quantity distributions of the developing blades according to Examples 33 to 36 each having the structure (1) and/or the structure (2) were 3.4 or less, i.e., the blades showed satisfactory values.

Meanwhile, in the developing blade according to Comparative Example 11 containing the fluorine resin not bonded to the urethane resin, the fluorine resin was peeled by the printing on many sheets, and hence the suppressing effect of the blade on the adhesion of the toner disappeared and fogging occurred after the endurance.

The developing blade according to Comparative Example 12 was free of the first polymer having at least one of the structures (1) to (6), and hence a sufficient triboelectric charge quantity could not be imparted to the toner, and the fogging values before and after the endurance were high.

In the developing blade according to Comparative Example 13 in which the value for the Nn was as low as 0.01 atomic %, the fogging values before and after the endurance were high because the amount of the first polymer present near the surface layer was small and hence a sufficient triboelectric charge quantity-imparting effect could not be exhibited.

In the developing blade according to Comparative Example 14 containing the fluorine resin D-2 having the structure (2), a perfluorohexyl group, and a siloxane-containing group, the fogging values before and after the endurance were high. In the developing blade according to Comparative Example 14, the Nna is smaller than the Nnb, and hence a hydrophobic group, such as a perfluorohexyl group, and a hydrophilic group, such as the structure (2), are present under such a state as to be dispersed. Accordingly, hydrophobic groups or hydrophilic groups are liable to form a domain. When the structure (2) serving as a hydrophilic group forms a domain, a triboelectric charge imparting ability is improved only in a portion where the domain is present. As a result, a difference occurs between the triboelectric charge quantities of the toner in contact with the domain and the toner out of contact therewith to enlarge the triboelectric charge quantity distribution of the toner. As the charge quantity distribution enlarges, toner having a low charge quantity also occurs. Thus, fogging occurred.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-135851, filed Jul. 8, 2016, which is hereby incorporated by reference herein in its entirety.

What is claimed is:

1. An electrophotographic member, comprising:

an electro-conductive substrate; and an electro-conductive resin layer serving as a surface layer on the substrate, wherein:

the surface layer contains a urethane resin and a first polymer having at least one structure selected from the group consisting of structures represented by the following structural formulae (1) to (6):

(1)

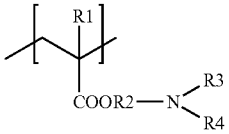

(2)

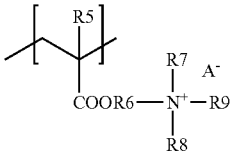

(3)

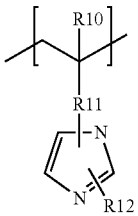

-continued (4)

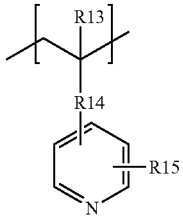

(5)

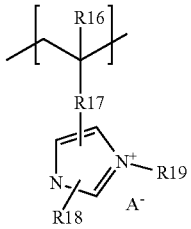

(6)

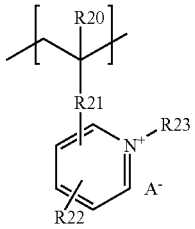

in the structural formulae (1) to (6),

R1, R5, R10, R13, R16, and R20 each independently represent a hydrogen atom or a methyl group, R2 and R6 each independently represent a hydrocarbon chain having 2 to 4 carbon atoms, R3 and R4 each independently represent a methyl group or an ethyl group, R7, R8, and R9 each independently represent a hydrocarbon group having 1 to 18 carbon atoms, R11, R14, R17, and R21 each independently represent a single bond or a hydrocarbon chain having 1 to 6 carbon atoms, R12, R15, R18, and R22 each independently represent a hydrogen atom or a hydrocarbon group having 1 to 3 carbon atoms, R19 and R23 each independently represent a hydrocarbon group having 1 to 13 carbon atoms, and $A^-$'s each independently represent a halogen ion or a p-toluenesulfonate ion;

the urethane resin has one of a structure derived from a second polymer containing a fluorine atom, and a structure derived from a third polymer containing a fluorine atom and a silicon atom;

wherein, in a region from an outer surface of the surface layer to a depth of 300 nm, a ratio of a total number of nitrogen atoms derived from the structures represented by the structural formulae (1) to (6) in the first polymer to a total number of atoms measured by X-ray photoelectron spectroscopy (ESCA), is 0.1 atomic % or more and 7.0 atomic % or less, and wherein, when, in a region from a depth of 100 nm from the outer surface of the surface layer to a depth of 300 nm, a ratio of a total number of nitrogen atoms derived from the structures represented by the structural formulae (1) to (6) in the first polymer to a total number of atoms measured by the X-ray photoelectron spectroscopy (ESCA) is defined as Nna, a ratio of a number of fluorine atoms derived from the urethane resin to the total number of the atoms measured by the X-ray photoelectron spectroscopy (ESCA) is defined as Fna, and a ratio of a number of silicon atoms derived from the urethane resin to the total number of the atoms measured by the X-ray photoelectron spectroscopy (ESCA) is defined as Sina;

and in a region from the outer surface of the surface layer to a depth of 10 nm, a ratio of a total number of nitrogen atoms derived from the structures represented by the structural formulae (1) to (6) in the first polymer to a total number of atoms measured by the X-ray photoelectron spectroscopy (ESCA) is defined as Nnb, a ratio of a number of fluorine atoms derived from the urethane resin to the total number of the atoms measured by the X-ray photoelectron spectroscopy (ESCA) is defined as Fnb, and a ratio of a number of silicon atoms derived from the urethane resin to the total number of the atoms measured by the X-ray photoelectron spectroscopy (ESCA) is defined as Sinb, the Nna, the Fna, the Sina, the Nnb, the Fnb, and the Sinb satisfy relationships represented by the following expression (1) and the following expression (2):

$$(Fna+Sina)<(Fnb+Sinb) \quad \text{Expression (1)}$$

$$Nna>Nnb. \quad \text{Expression (2)}$$

2. An electrophotographic member according to claim 1, wherein a sum (Fnb+Sinb) of the ratios of the numbers of the fluorine atoms and the silicon atoms derived from the urethane resin to the total number of the atoms measured by the X-ray photoelectron spectroscopy (ESCA) in the region from the outer surface of the surface layer to a depth of 10 nm is 10.0 atomic % or more.

3. An electrophotographic member according to claim 1, wherein the first polymer further has a structure represented by the following structural formula (7):

(7)

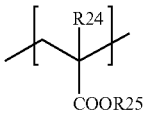

in the structural formula (7), R24 represents a hydrogen atom or a methyl group, and R25 represents a hydrocarbon group having 1 to 18 carbon atoms.

4. An electrophotographic member according to claim 1, wherein the first polymer has at least one of the structures represented by the structural formulae (1) and (2).

5. An electrophotographic member according to claim 1, wherein the second polymer comprises a polymer of a polymer polyol containing a fluorine atom and a polyisocyanate.

6. An electrophotographic member according to claim 5, wherein the polymer polyol containing a fluorine atom comprises a polymer of one of a fluoroethylene and a (meth)acrylate having a fluoroalkyl group, and a monomer having a hydroxy group.

7. An electrophotographic member according to claim 1, wherein the third polymer comprises a polymer of a polymer polyol containing a fluorine atom and a silicon atom, and a polyisocyanate.

8. An electrophotographic member according to claim 7, wherein the polymer polyol containing a fluorine atom and a silicon atom comprises a polymer of one of a fluoroethylene and a (meth)acrylate having a fluoroalkyl group, a (meth)acrylate having a silicone group, and a monomer having a hydroxy group.

9. An electrophotographic member according to claim 1, wherein the surface layer comprises a cured product of a layer of a paint for forming a surface layer containing the following (a1) to (a4):

(a1) the first polymer;

(a2) at least one of the second polymer or the third polymer;

(a3) a polymer polyol free of a fluorine atom and a silicon atom; and (a4) a polyisocyanate.

10. A process cartridge, comprising an electrophotographic member, the process cartridge being removably mounted onto a main body of an electrophotographic apparatus, wherein:

the electrophotographic member includes an electro-conductive substrate and an electro-conductive resin layer serving as a surface layer on the substrate;

the surface layer contains a urethane resin and a first polymer having at least one structure selected from the group consisting of structures represented by the following structural formulae (1) to (6):

(1)

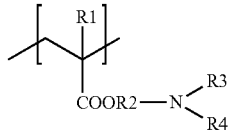

(2)

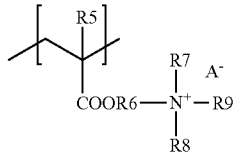

(3)

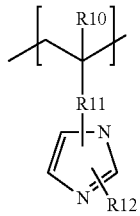

(4)

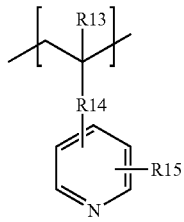

-continued (5)

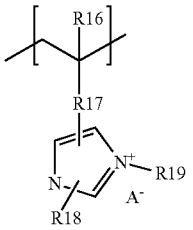

(6)

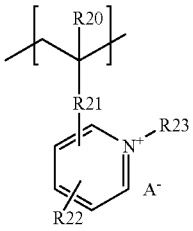

in the structural formulae (1) to (6),

R1, R5, R10, R13, R16, and R20 each independently represent a hydrogen atom or a methyl group, R2 and R6 each independently represent a hydrocarbon chain having 2 to 4 carbon atoms, R3 and R4 each independently represent a methyl group or an ethyl group, R7, R8, and R9 each independently represent a hydrocarbon group having 1 to 18 carbon atoms, R11, R14, R17, and R21 each independently represent a single bond or a hydrocarbon chain having 1 to 6 carbon atoms, R12, R15, R18, and R22 each independently represent a hydrogen atom or a hydrocarbon group having 1 to 3 carbon atoms, R19 and R23 each independently represent a hydrocarbon group having 1 to 13 carbon atoms, and $A^-$'s each independently represent a halogen ion or a p-toluenesulfonate ion;

the urethane resin has one of a structure derived from a second polymer containing a fluorine atom, and a structure derived from a third polymer containing a fluorine atom and a silicon atom;

wherein, in a region from an outer surface of the surface layer to a depth of 300 nm, a ratio of a total number of nitrogen atoms derived from the structures represented by the structural formulae (1) to (6) in the first polymer to a total number of atoms measured by X-ray photoelectron spectroscopy (ESCA), is 0.1 atomic % or more and 7.0 atomic % or less, and wherein, when, in a region from a depth of 100 nm from the outer surface of the surface layer to a depth of 300 nm, a ratio of a total number of nitrogen atoms derived from the structures represented by the structural formulae (1) to (6) in the first polymer to a total number of atoms measured by the X-ray photoelectron spectroscopy (ESCA) is defined as Nna, a ratio of a number of fluorine atoms derived from the urethane resin to the total number of the atoms measured by the X-ray photoelectron spectroscopy (ESCA) is defined as Fna, and a ratio of a number of silicon atoms derived from the urethane resin to the total number of the atoms measured by the X-ray photoelectron spectroscopy (ESCA) is defined as Sina;

and in a region from the outer surface of the surface layer to a depth of 10 nm, a ratio of a total number of nitrogen atoms derived from the structures represented by the structural formulae (1) to (6) in the first polymer to a total number of atoms measured by the X-ray photoelectron spectroscopy (ESCA) is defined as Nnb, a ratio of a number of fluorine atoms derived from the urethane resin to the total number of the atoms measured by the X-ray photoelectron spectroscopy (ESCA) is defined as Fnb, and a ratio of a number of silicon atoms derived from the urethane resin to the total number of the atoms measured by the X-ray photoelectron spectroscopy (ESCA) is defined as Sinb, the Nna, the Fna, the Sina, the Nnb, the Fnb, and the Sinb satisfy relationships represented by the following expression (1) and the following expression (2):

$$(Fna+Sina)<(Fnb+Sinb) \quad \text{Expression (1)}$$

$$Nna>Nnb. \quad \text{Expression (2)}$$

11. An electrophotographic apparatus, comprising an electrophotographic member, wherein:

the electrophotographic member includes an electro-conductive substrate and an electro-conductive resin layer serving as a surface layer on the substrate;

the surface layer contains a urethane resin and a first polymer having at least one structure selected from the group consisting of structures represented by the following structural formulae (1) to (6):

(1)

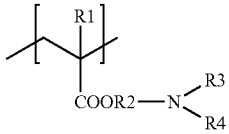

(2)

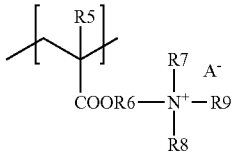

(3)

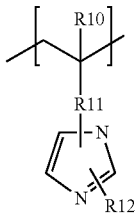

-continued (4)

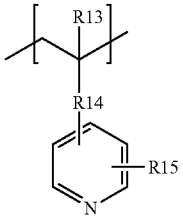

(5)

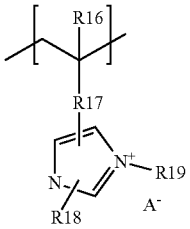

(6)

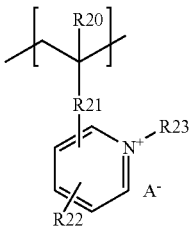

in the structural formulae (1) to (6),

R1, R5, R10, R13, R16, and R20 each independently represent a hydrogen atom or a methyl group, R2 and R6 each independently represent a hydrocarbon chain having 2 to 4 carbon atoms, R3 and R4 each independently represent a methyl group or an ethyl group, R7, R8, and R9 each independently represent a hydrocarbon group having 1 to 18 carbon atoms, R11, R14, R17, and R21 each independently represent a single bond or a hydrocarbon chain having 1 to 6 carbon atoms, R12, R15, R18, and R22 each independently represent a hydrogen atom or a hydrocarbon group having 1 to 3 carbon atoms, R19 and R23 each independently represent a hydrocarbon group having 1 to 13 carbon atoms, and $A^-$'s each independently represent a halogen ion or a p-toluenesulfonate ion;

the urethane resin has one of a structure derived from a second polymer containing a fluorine atom, and a structure derived from a third polymer containing a fluorine atom and a silicon atom;

wherein, in a region from an outer surface of the surface layer to a depth of 300 nm, a ratio of a total number of nitrogen atoms derived from the structures represented by the structural formulae (1) to (6) in the first polymer to a total number of atoms measured by X-ray photoelectron spectroscopy (ESCA), is 0.1 atomic % or more and 7.0 atomic % or less, and wherein, when, in a region from a depth of 100 nm from the outer surface of the surface layer to a depth of 300 nm, a ratio of a total number of nitrogen atoms derived from the structures represented by the structural formulae (1) to (6) in the first polymer to a total number of atoms measured by the X-ray photoelectron spectroscopy (ESCA) is defined as Nna, a ratio of a number of fluorine atoms derived from the urethane resin to the total number of the atoms measured by the X-ray photoelectron spectroscopy (ESCA) is defined as Fna, and a ratio of a number of silicon atoms derived from the urethane resin to the total number of the atoms measured by the X-ray photoelectron spectroscopy (ESCA) is defined as Sina;

and in a region from the outer surface of the surface layer to a depth of 10 nm, a ratio of a total number of nitrogen atoms derived from the structures represented by the structural formulae (1) to (6) in the first polymer to a total number of atoms measured by the X-ray photoelectron spectroscopy (ESCA) is defined as Nnb, a ratio of a number of fluorine atoms derived from the urethane resin to the total number of the atoms measured by the X-ray photoelectron spectroscopy (ESCA) is defined as Fnb, and a ratio of a number of silicon atoms derived from the urethane resin to the total number of the atoms measured by the X-ray photoelectron spectroscopy (ESCA) is defined as Sinb, the Nna, the Fna, the Sina, the Nnb, the Fnb, and the Sinb satisfy relationships represented by the following expression (1) and the following expression (2):

$$(Fna+Sina)<(Fnb+Sinb) \quad \text{Expression (1)}$$

$$Nna>Nnb. \quad \text{Expression (2)}$$

* * * * *